US005917452A

United States Patent [19]

Harada et al.

[11] Patent Number: 5,917,452

[45] Date of Patent: Jun. 29, 1999

[54] NOISE REDUCING ROD VEHICLE ANTENNA

[75] Inventors: Jiro Harada, Tokyo; Masaki Shinkawa, Yamato; Shinichi Saito, Tokyo; Hiroyoshi Kojima, Kawasaki, all of Japan

[73] Assignee: Harada Industry Co., Ltd., Tokyo, Japan

[21] Appl. No.: 08/807,420

[22] Filed: Feb. 28, 1997

[30] Foreign Application Priority Data

Feb. 29, 1996 [JP] Japan ..... 8-043743

[51] Int. Cl.[6] ..... H01Q 1/32

[52] U.S. Cl. ..... 343/715; 343/DIG. 1; 343/900

[58] Field of Search ..... 343/715, 722, 343/749, 900, 901, 903, DIG. 1; H01Q 1/32

[56] References Cited

U.S. PATENT DOCUMENTS 4,513,338 4/1985 Goodall et al. ..... 343/900
5,151,711 9/1992 Taguchi ..... 343/DIG. 1

FOREIGN PATENT DOCUMENTS 2846344 5/1980 Germany ..... 343/DIG. 1

*Primary Examiner*—Don Wong
*Assistant Examiner*—Tho Phan
*Attorney, Agent, or Firm*—John P. White; Cooper & Dunham LLP

[57] ABSTRACT

A rod-shaped vehicle antenna according to the present invention, includes a rod-shaped antenna element having small- and large-diameter portions arranged alternately at regular pitches along the longitudinal direction of a rod-shaped conductor. When the outside diameter of each of the small-diameter portions is D1, that of each of the large-diameter portions is D2, and the pitch (length of each of the small- and large-diameter portions) is P, P is set within the following range:

$$(D2\times6)\leqq P\leqq(D2\times7).$$ The ratio of D1 to D2, that is, D1/D2 is set within the following range:

$$0.7\leqq(D1/D2)\leqq0.85.$$

2 Claims, 22 Drawing Sheets

NOISE REDUCING ROD VEHICLE ANTENNA

BACKGROUND OF THE INVENTION

The present invention relates to a rod-shaped antenna provided for vehicles such as automobiles and, more particularly, to a rod-shaped automobile antenna having a means for eliminating a whistling sound generated during the vehicle driving operation.

A rod-shaped antenna, which is constituted of an antenna element of a rod-shaped conductor, has been widely used for vehicles such as automobiles. This rod-shaped antenna generates a so-called whistling sound when an automobile runs at high speed or when the running automobile is exposed to a strong wind. Not a little, the whistling sound makes the occupants of the automobile uncomfortable. Various measures have been so far taken to eliminate the whistling sound.

Jpn. Utility Model Appln. KOKAI Publication No. 53-17136 discloses an automobile pole antenna having a whistling sound reduction means. This antenna is constituted by slidably joining conductive pipes of different diameters to each other, and a spiral wire is wounded on the outer circumference of the first element (conductive pipe). The above publication also discloses a pole antenna wherein a groove is formed circularly or spirally in the first element and a spiral wire is wounded on the groove.

The above automobile pole antenna has a drawback wherein a whistling sound cannot be eliminated so greatly though its structure is relatively complicated.

BRIEF SUMMARY OF THE INVENTION

It is accordingly an object of the present invention to provide a rod-shaped vehicle antenna which greatly eliminates a whistling sound though its structure is simple and which is easily manufactured and selectively sets the modes of whistling sound eliminating elements relatively easily in accordance with its using conditions.

To attain the above object, the rod-shaped vehicle antenna according to the present invention has the following construction.

(1) A rod-shaped vehicle antenna includes a rod-shaped antenna element having small-diameter portions and large-diameter portions arranged alternately at regular pitches along the longitudinal direction of a rod-shaped conductor. When the outside diameter of each of the small-diameter portions is D1, the outside diameter of each of the large-diameter portions is D2, and the pitches are represented by P, P is set within the following range:

$$(D2\times 6)\leqq P\leqq (D2\times 7);\ \text{and}$$

a ratio of D1 to D2, that is, D1/D2 is set within the following range:

$$0.7\leqq (D1/D2)\leqq 0.85.$$

(2) In the rod-shaped vehicle antenna, the antenna element has an area where the small-diameter portions and the large-diameter portions are formed, and the length of the area is ⅔ or more of the whole length of the antenna element.

(3) A rod-shaped vehicle antenna includes a rod-shaped antenna element having small-diameter portions and large-diameter portions arranged alternately at regular pitches along the longitudinal direction of a rod-shaped conductor. When the outside diameter of each of the small-diameter portions is D1, the length thereof is P1, the outside diameter of each of the large-diameter portions is D2, and the length thereof is P2, P1 and P2 are set within a following range:

$$(D2\times 6)\leqq P1\leqq (D2\times 7)$$

$$(D2\times 6)\leqq P2\leqq (D2\times 7);$$

the ratio Q of P1 to P2 (P1/P2) or P2 to P1 (P2/P1) falls within a following range:

$$(1/3)\leqq Q\leqq 1;\ \text{and}$$

the ratio of D1 to D2 (D1/D2) is set as follows:

$$(D1/D2)\leqq 0.75.$$

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION (First Embodiment)

Figure 1:
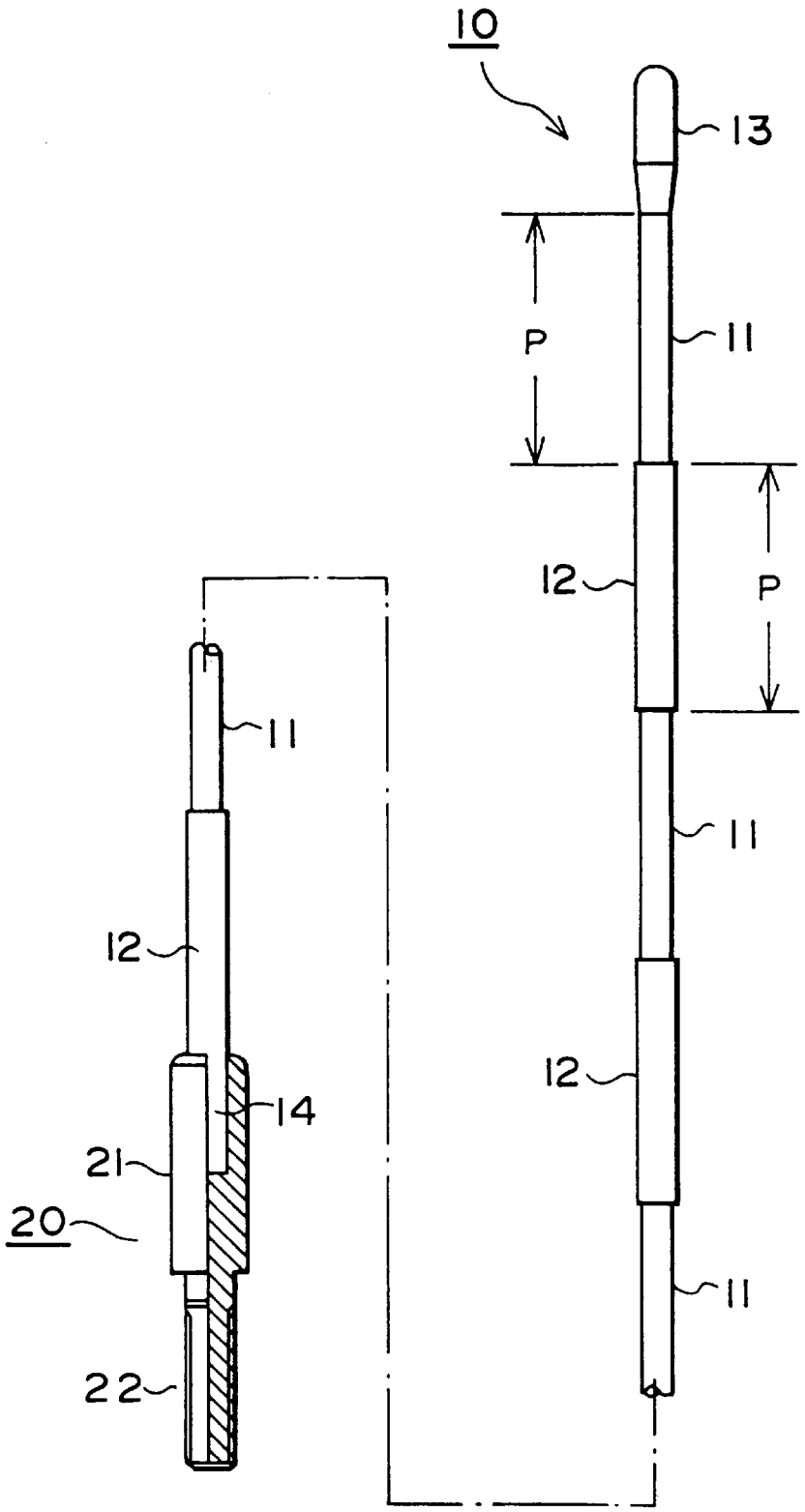
FIG. 1 is a cutaway front view of the constitution of a rod-shaped automobile antenna according to a first embodiment of the present invention.

FIG. 1 illustrates a rod-shaped automobile antenna including a rod-shaped antenna element 10 and a joint 20 attached to the bottom end portion of the antenna element 10.

The antenna element 10 is constituted of small-diameter portions 11 and large-diameter portions 12 which are arranged alternately at predetermined pitch P along the longitudinal direction of a rod-shaped conductor (e.g., a conductive pipe). The top end of the element 10 is provided with a cap portion 13 and the bottom end thereof is provided with a coupling portion 14.

The joint 20 is formed of conductive material and includes a large-diameter coupling portion 21 and a small-diameter screw portion 22. The coupling portion 21 is fitted to the coupling portion 14 of the antenna element 10 to be formed integrally as one component. The small-diameter screw portion 22 is screwed into a power supply of an antenna mounting mechanism mounted on an automobile body (not shown), that is, they are electrically and mechanically coupled to each other.

Figure 2:
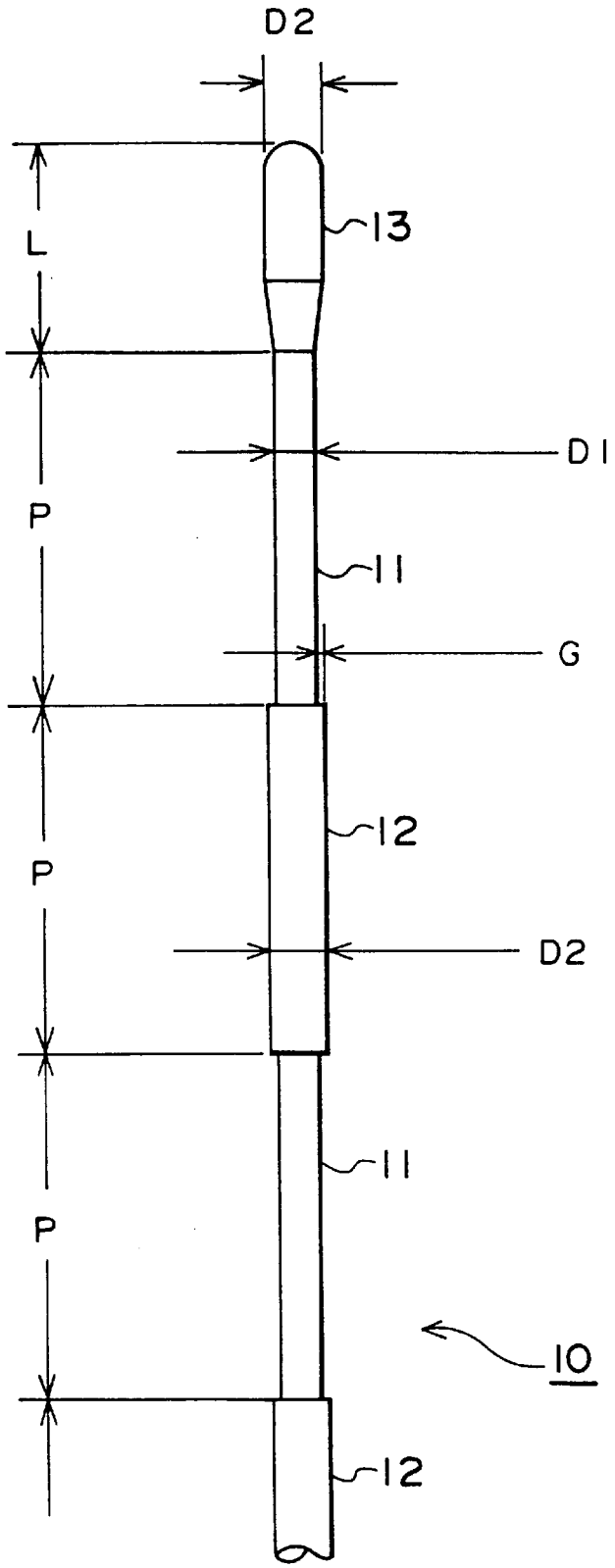
FIG. 2 is a view showing the measurement ratio of the rod-shaped automobile antenna according to the first embodiment of the present invention.

Assume that, as shown in FIG. 2, the outside diameter of the small-diameter portion 11 is D1 and that of the large-diameter portion 12 is D2. The pitch P corresponds to the length of each of the small-diameter and large-diameter portions 11 and 12. In FIG. 2, G indicates half of a difference between the outside diameters D1 and D2 (D2–D1), i.e., a step, while L represents the length of the cap portion 13.

In the first embodiment, when D2 is about Φ4, P is set within the following range:

$$(D2\times 6)\leqq P\leqq (D2\times 7)$$

Then the ratio of D1 to D2 (D1/D2) is set within the following range.

$$0.7\leqq (D1/D2)\leqq 0.85$$

As one example of the preferred embodiment, D1 is Φ3, D2 is Φ4, and P is 25 mm.

In the rod-shaped antenna element 10, the small-diameter and large-diameter portions 11 and 12 and cap portion 13 are formed integrally as one component by a single rod-shaped conductive member by deforming the member using a deforming means such as cutting and swaging.

Figure 3:
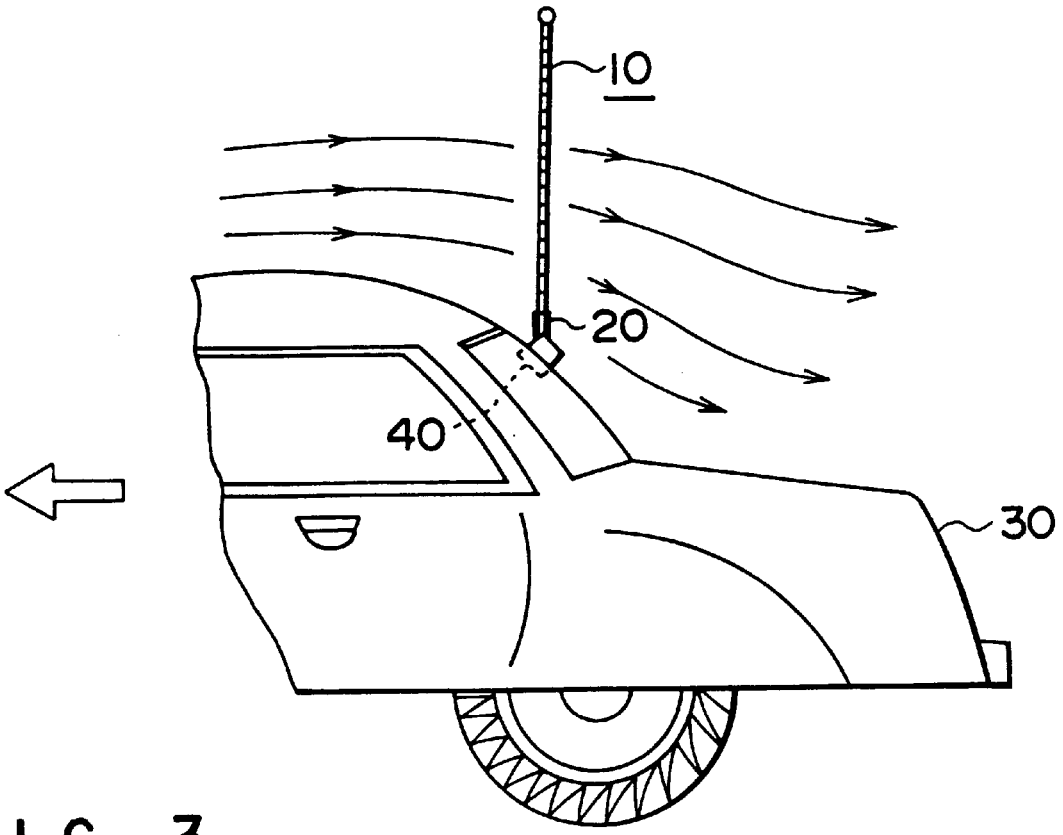
FIG. 3 is a view of the use of the rod-shaped automobile antenna according to the first embodiment of the present invention.
Figure 4:
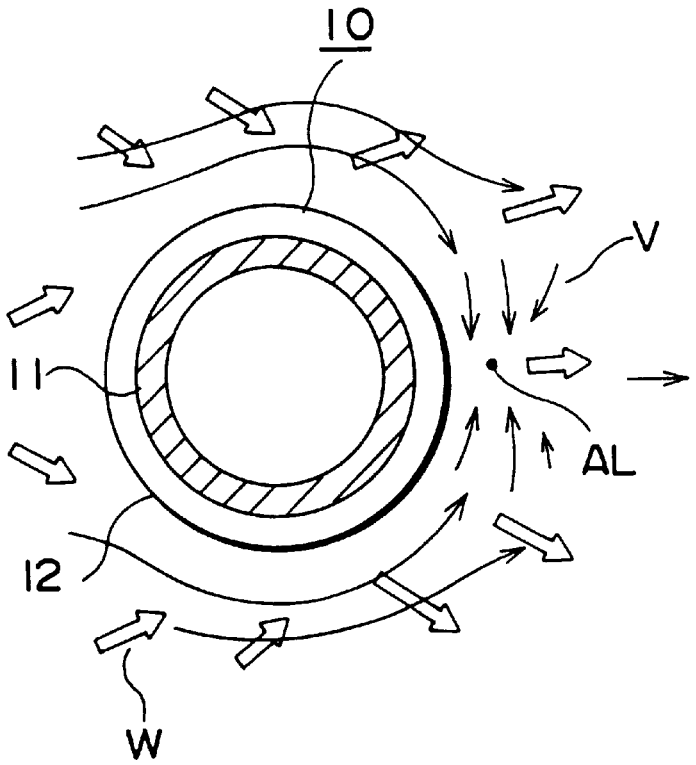
FIG. 4 is a view of a basic action of the rod-shaped automobile antenna according to the first embodiment of the present invention.

FIG. 3 is a view of the use of the rod-shaped automobile antenna having the above constitution, while FIG. 4 is a view of the basic action thereof. In order to mount the rod-shaped automobile antenna on the body of an automobile 30, as shown in FIG. 3, the joint 20 coupled to the bottom end of the antenna element 10 is screwed and secured to an antenna mounting mechanism 40 mounted in advance on the body of the automobile 30. When the antenna is provided with predetermined wiring (not shown), it fulfills its own function.

When the automobile 30 with the rod-shaped automobile antenna runs on an expressway or the like at a high speed in the direction of a big outlined arrow of FIG. 3, a low pressure region AL tends to be created on the lee side of the antenna element 10, as shown in FIG. 4. If the region AL is created, the surrounding air of the antenna element 10 spins backward, as indicated by small arrows V of FIG. 4, and flows into the low pressure region AL, with the result that small vibrations occur mainly in the forward and backward directions of the antenna 10 to create a so-called whistling sound or noise.

In the rod-shaped automobile antenna of the first embodiment, as described above, the small-diameter portions 11 and large-diameter portions 12, between which there is a step (level difference) G, are provided alternately, so that they generate a turbulent flow as shown by the big arrows W in FIG. 4. This turbulent flow disturbs the low pressure region AL which is to be created on the lee side of the antenna element 10, and the region AL is thus scattered and disappears. Thus, the small vibrations of the antenna element 10 due to the creation of the low pressure region AL is suppressed and the whistling sound is diminished.

Figure 5:
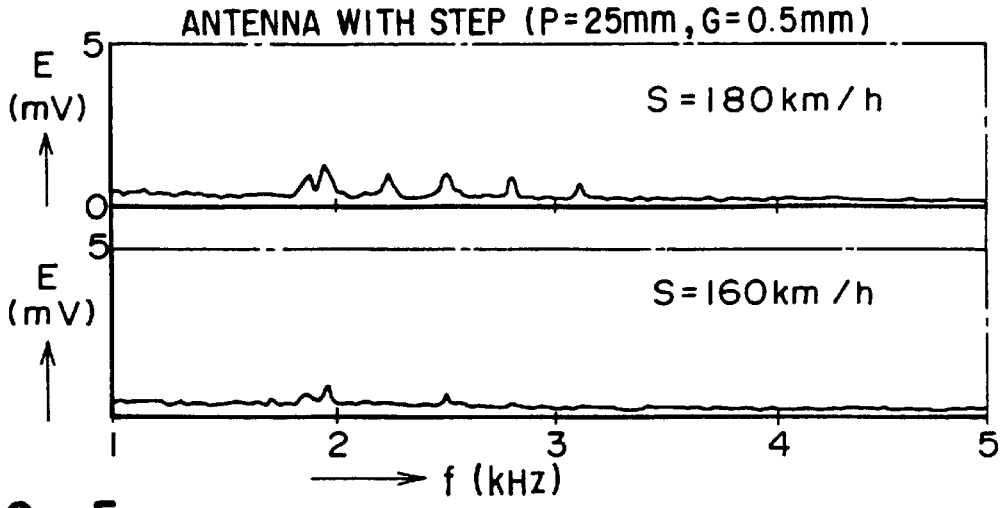
FIG. 5 is a graph of the whistling sound eliminating effect of the rod-shaped automobile antenna according to the first embodiment of the present invention.
Figure 6:
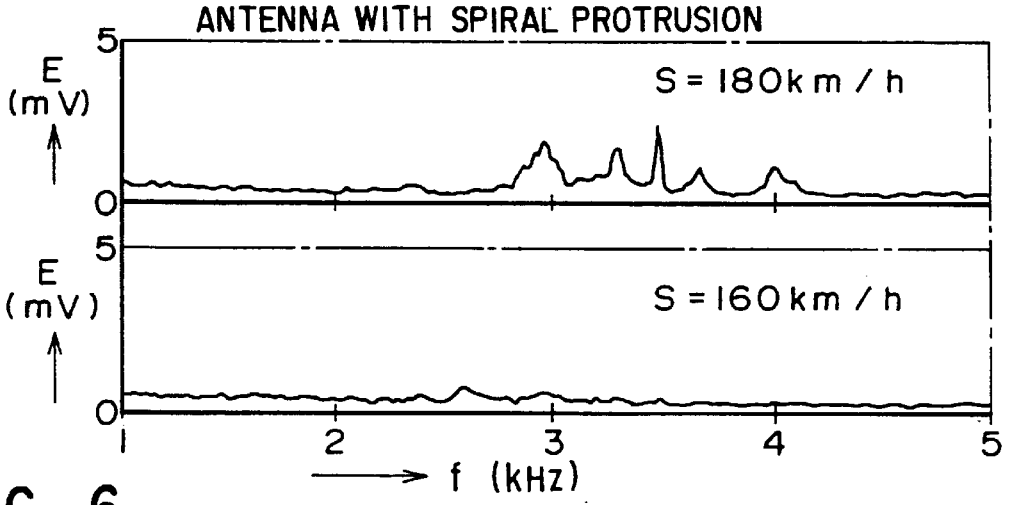
FIG. 6 is a graph of the whistling sound eliminating effect of a prior art rod-shaped automobile antenna with a spiral protrusion.
Figure 7:
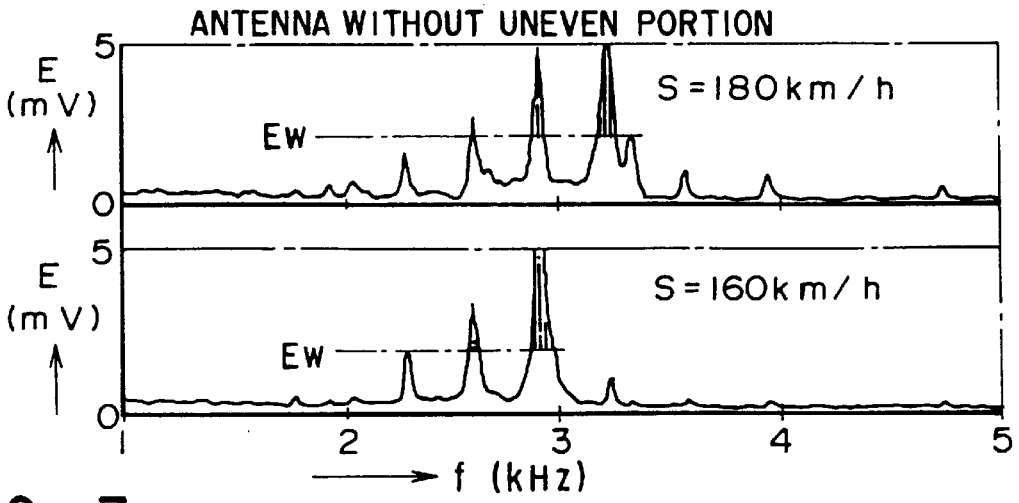
FIG. 7 is a graph of the whistling sound eliminating effect of a prior art rod-shaped automobile antenna without an uneven portion.

FIGS. 5 to 7 show that the whistling sound of the rod-shaped automobile antenna according to the first embodiment is reduced more greatly than that of the prior art antenna. More specifically, FIG. 5 is a graph of the whistling sound of the rod-shaped automobile antenna according to the first embodiment, FIG. 6 is that of a conventional rod-shaped automobile antenna with a spiral protrusion, and FIG. 7 is that of another conventional rod-shaped automobile antenna without an uneven portion.

The graphs of FIGS. 5 to 7 each represent the result of the experiment performed in a wind tunnel. To carry out this experiment, an acceleration sensor is mounted on the antenna mounting mechanism (mounting section) to which the bottom end of the rod-shaped antenna element is coupled perpendicularly to the horizontal plane. When the wind velocities in the wind tunnel are set to 160 Km/h and 180 Km/h, signals are picked up by the acceleration sensor and Fourier-transformed, thus obtaining a power spectrum of vibrations transmitted by the rod-shaped antenna element. In each of the graphs, the abscissa indicates a frequency f (kHz) and the ordinate does an amplitude E (mV). In FIG. 7, the region having an amplitude of Ew or higher is a noisy one where one feels noisy.

In the conventional rod-shaped antenna without an uneven portion, a region having an amplitude where one feels noisy appears in the vicinity of 3 kHz. In the conventional rod-shaped antenna with a spiral protrusion, as shown in FIG. 6, a certain effect of suppressing the whistling sound can be seen but is not so sufficient. In the rod-shaped automobile antenna according to the first embodiment, as illustrated in FIG. 5, most of whistling sound is eliminated since the antenna element 10 has small- diameter portion 11 and large-diameter portion 12.

The primary object of the rod-shaped automobile antenna according to the present invention is to eliminate the whistling sound to a negligible extent as audibility. However, the audibility varies from person to person, and a slight difference in audibility cannot be clearly distinguished; therefore, a fixed amount of information, which does not rely upon one's sense, is required. In the foregoing experiment, the vibration acceleration transmitted to the antenna mounting mechanism (mounting section) was picked up by the acceleration sensor and Fourier-transformed to obtain a power spectrum of vibration transmitted by the rod-shaped antenna element. It is however necessary to inspect whether the information acquired by the experiment correctly reflects "noisiness" of the whistling sound as audibility.

FIGS. 8 to 15 are graphs each showing the correlation between "data arranged by each of predetermined methods XA, XB, XC, XD, MA, MB, MC and MD" and "audibility estimated values" which are calculated experimentally in order to obtain a desirable data arrangement method for representing the whistling sound eliminating effect of the rod-shaped automobile antenna according to the first embodiment of the present invention in a fixed amount. The following are respective data arrangement methods and respective correlation coefficients corresponding thereto.

Figure 8:
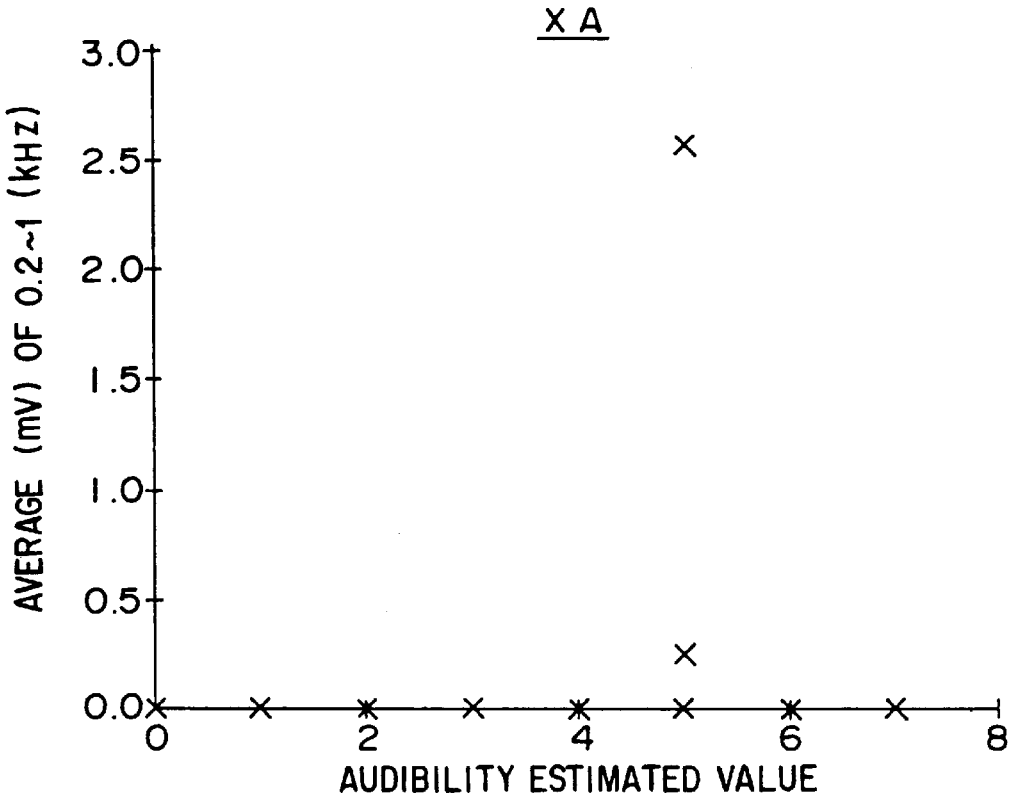
FIG. 8 is a graph of the correlation between "data arranged by a predetermined method XA" and "audibility estimated values" which are calculated experimentally in order to obtain a data arrangement method for representing the whistling sound eliminating effect of the rod-shaped automobile antenna according to the first embodiment of the present invention in a fixed amount.

(1) Data Arrangement Method XA (FIG. 8)

This method is to take an average of outputs of the sensor, which are 2 mV or more, when frequency f ranges from 0.2 kHz to 1 kHz. The corresponding correlation coefficient is 0.0541.

Figure 9:
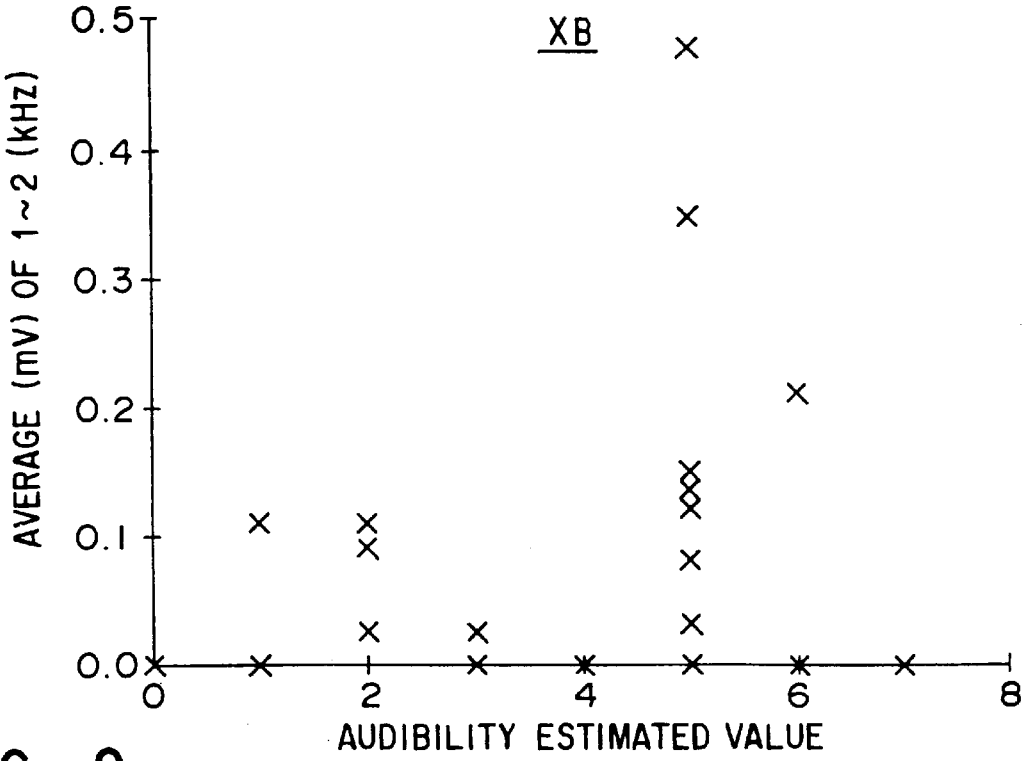
FIG. 9 is a graph of the correlation between "data arranged by a predetermined method XB" and "audibility estimated values" which are calculated experimentally in order to obtain a data arrangement method for representing the whistling sound eliminating effect of the rod-shaped automobile antenna according to the first embodiment of the present invention in a fixed amount.

(2) Data Arrangement Method XB (FIG. 9)

This method is to take an average of outputs of the sensor, which are 2 mV or more, when frequency f ranges from 1.0 kHz to 2 kHz. The corresponding correlation coefficient is 0.0368.

Figure 10:
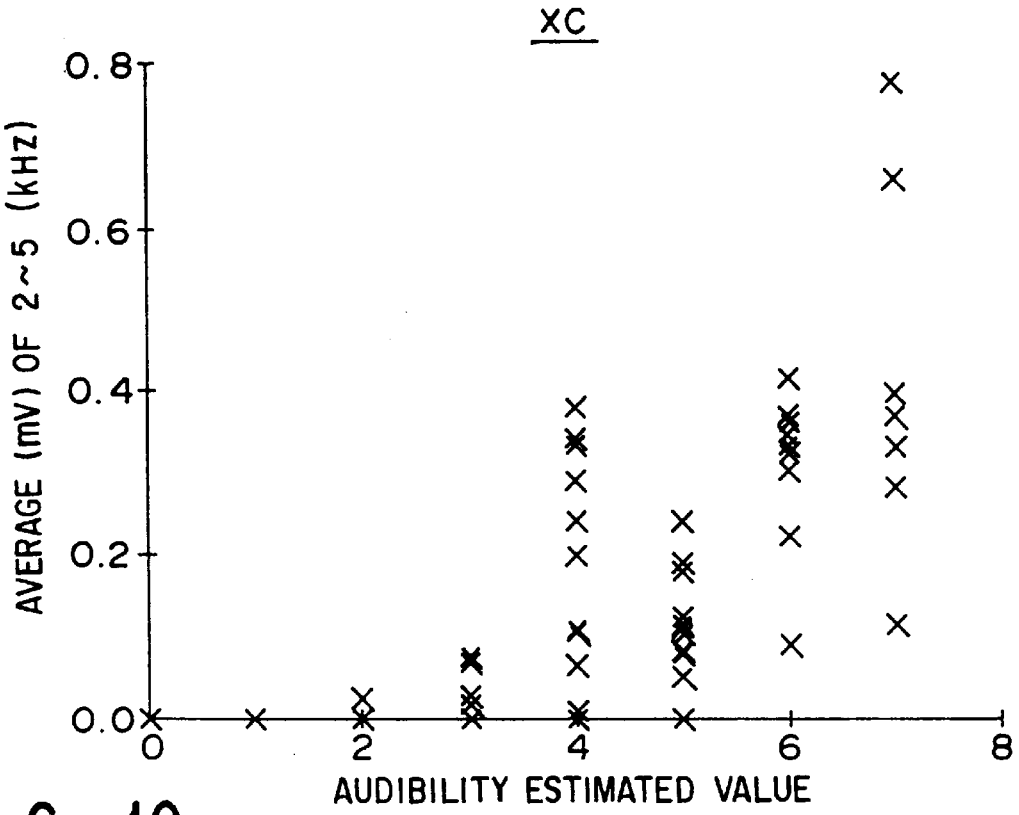
FIG. 10 is a graph of the correlation between "data arranged by a predetermined method XC" and "audibility estimated values" which are calculated experimentally in order to obtain a data arrangement method for representing the whistling sound eliminating effect of the rod-shaped automobile antenna according to the first embodiment of the present invention in a fixed amount.

(3) Data Arrangement Method XC (FIG. 10)

This method is to take an average of outputs of the sensor, which are 2 mV or more, when frequency f ranges from 2.0 kHz to 5 kHz. The corresponding correlation coefficient is 0.7103.

Figure 11:
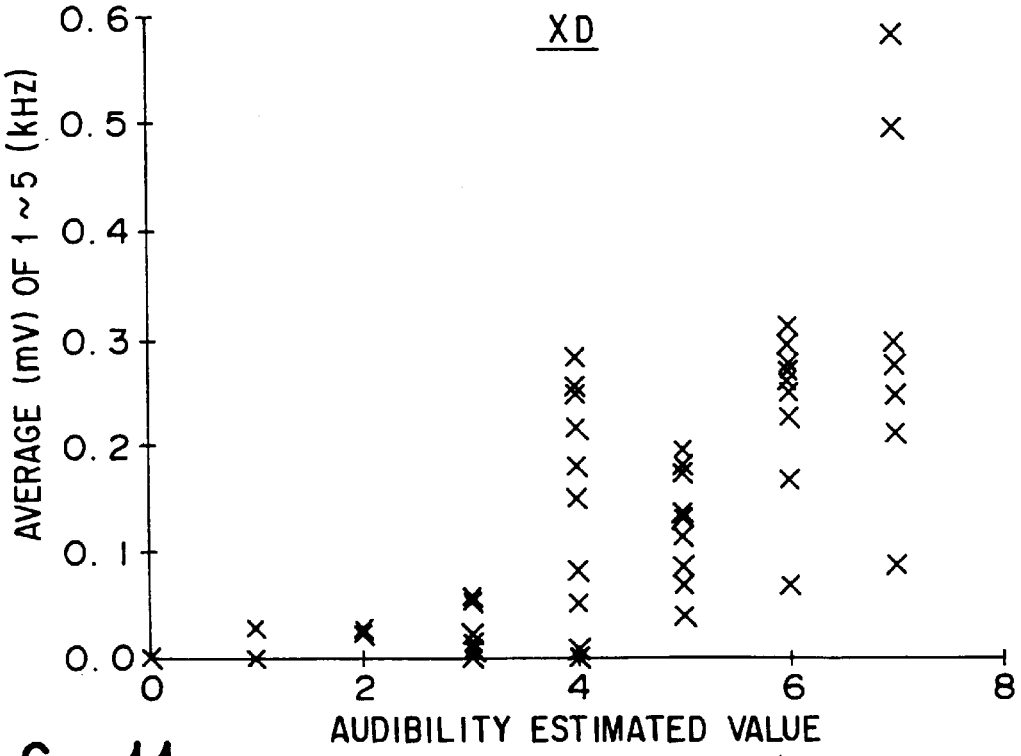
FIG. 11 is a graph of the correlation between "data arranged by a predetermined method XD" and "audibility estimated values" which are calculated experimentally in order to obtain a data arrangement method for representing the whistling sound eliminating effect of the rod-shaped automobile antenna according to the first embodiment of the present invention in a fixed amount.

(4) Data Arrangement Method XD (FIG. 11)

This method is to take an average of outputs of the sensor, which are 2 mV or more, when frequency f ranges from 1.0 kHz to 5 kHz. The corresponding correlation coefficient is 0.7228.

Figure 12:
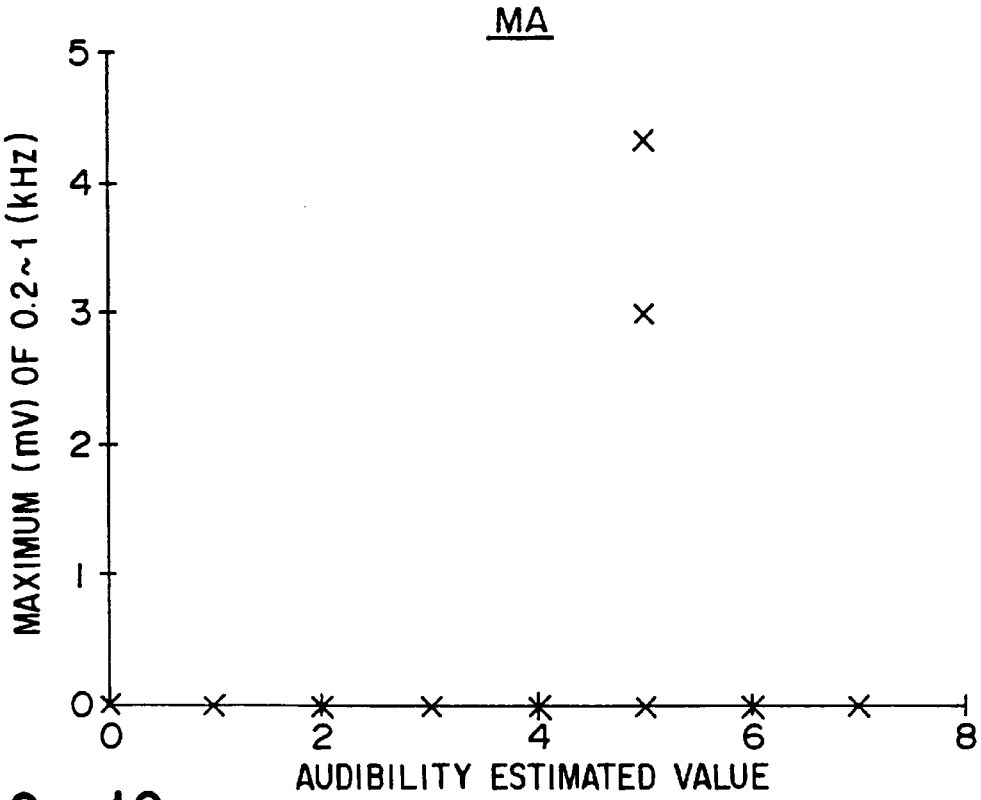
FIG. 12 is a graph of the correlation between "data arranged by a predetermined method MA" and "audibility estimated values" which are calculated experimentally in order to obtain a data arrangement method for representing the whistling sound eliminating effect of the rod-shaped automobile antenna according to the first embodiment of the present invention in a fixed amount.

(5) Data Arrangement Method MA (FIG. 12)

This method is to obtain the maximum value of outputs of the sensor, which are 2 mV or more, when frequency f ranges from 0.2 kHz to 1 kHz. The corresponding correlation coefficient is 0.0696.

Figure 13:
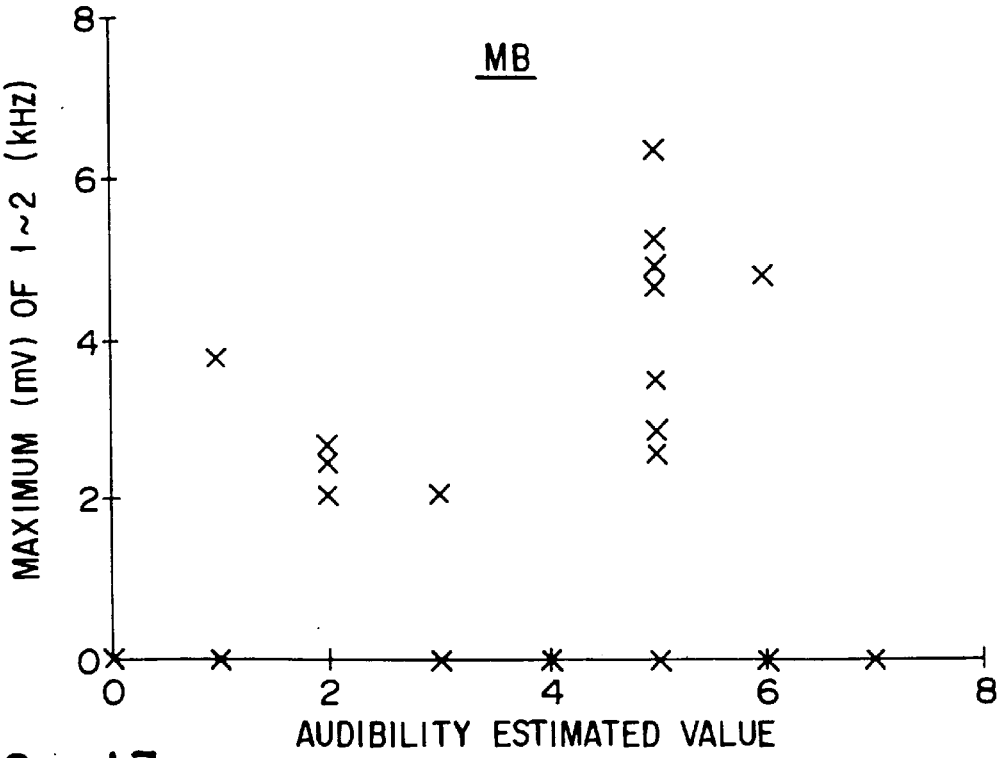
FIG. 13 is a graph of the correlation between "data arranged by a predetermined method MB" and "audibility estimated values" which are calculated experimentally in order to obtain a data arrangement method for representing the whistling sound eliminating effect of the rod-shaped automobile antenna according to the first embodiment of the present invention in a fixed amount.

(6) Data Arrangement Method MB (FIG. 13)

This method is to obtain the maximum value of outputs of the sensor, which are 2 mV or more, when frequency f ranges from 1.0 kHz to 2 kHz. The corresponding correlation coefficient is 0.0198.

Figure 14:
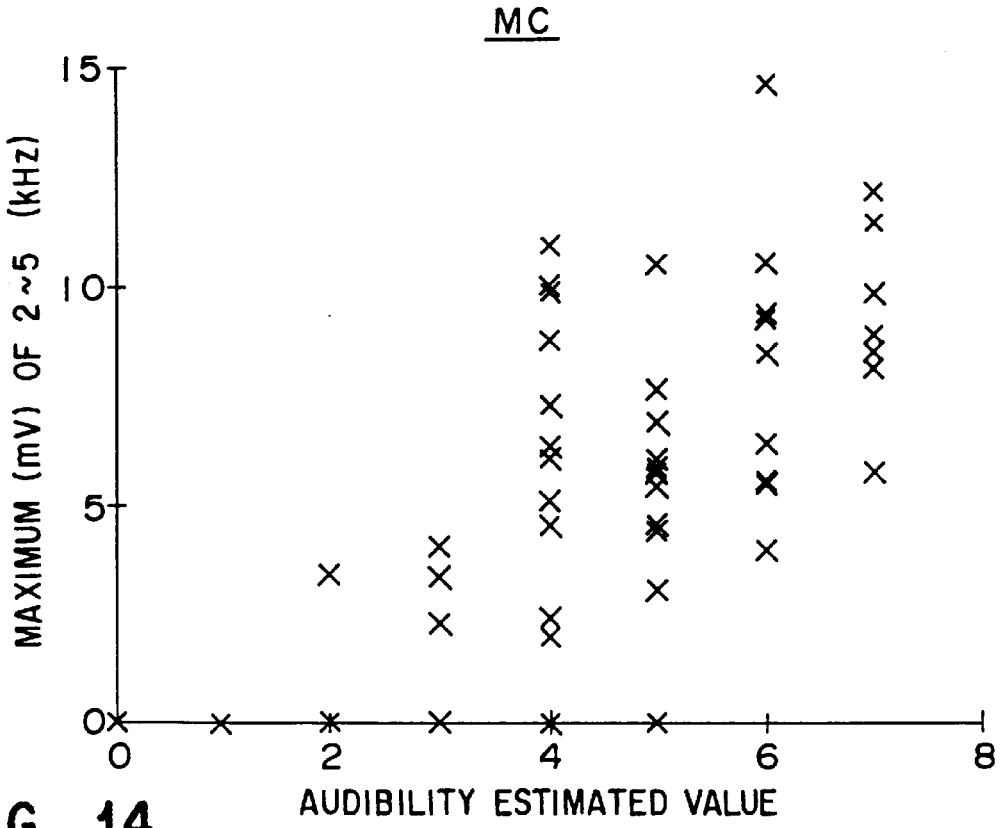
FIG. 14 is a graph of the correlation between "data arranged by a predetermined method MC" and "audibility estimated values" which are calculated experimentally in order to obtain a data arrangement method for representing the whistling sound eliminating effect of the rod-shaped automobile antenna according to the first embodiment of the present invention in a fixed amount.

(7) Data Arrangement Method MC (FIG. 14)

This method is to obtain the maximum value of outputs of the sensor, which are 2 mV or more, when frequency f ranges from 2.0 kHz to 5 kHz. The corresponding correlation coefficient is 0.7399.

Figure 15:
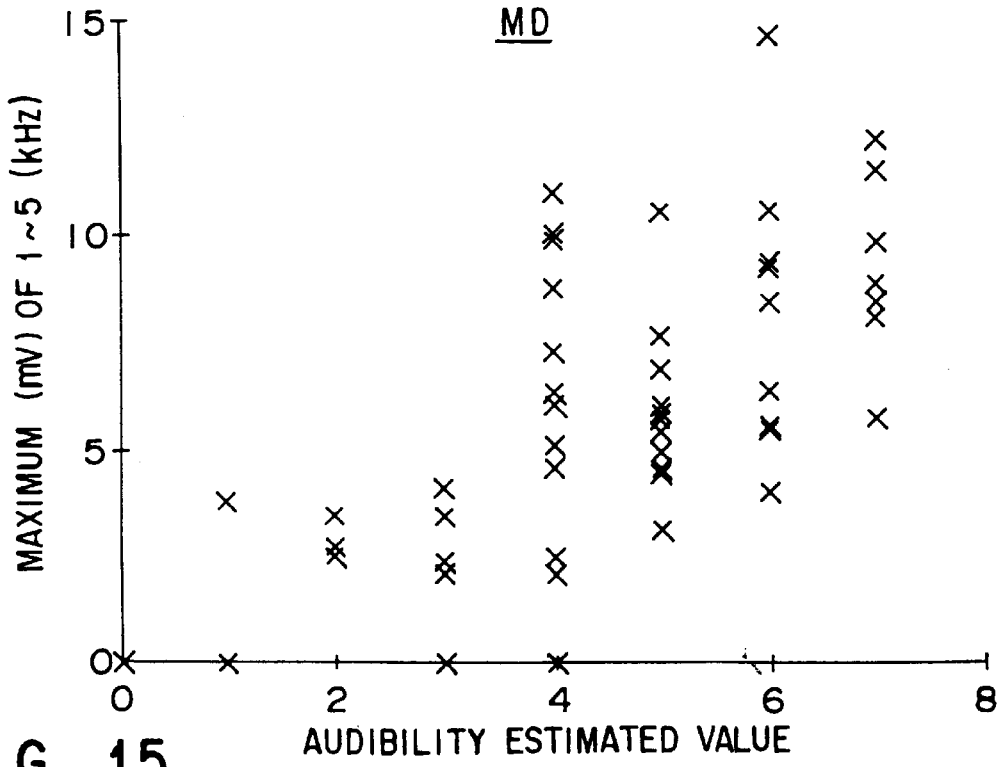
FIG. 15 is a graph of the correlation between "data arranged by a predetermined method MD" and "audibility estimated values" which are calculated experimentally in order to obtain a data arrangement method for representing the whistling sound eliminating effect of the rod-shaped automobile antenna according to the first embodiment of the present invention in a fixed amount.
Figure 16:
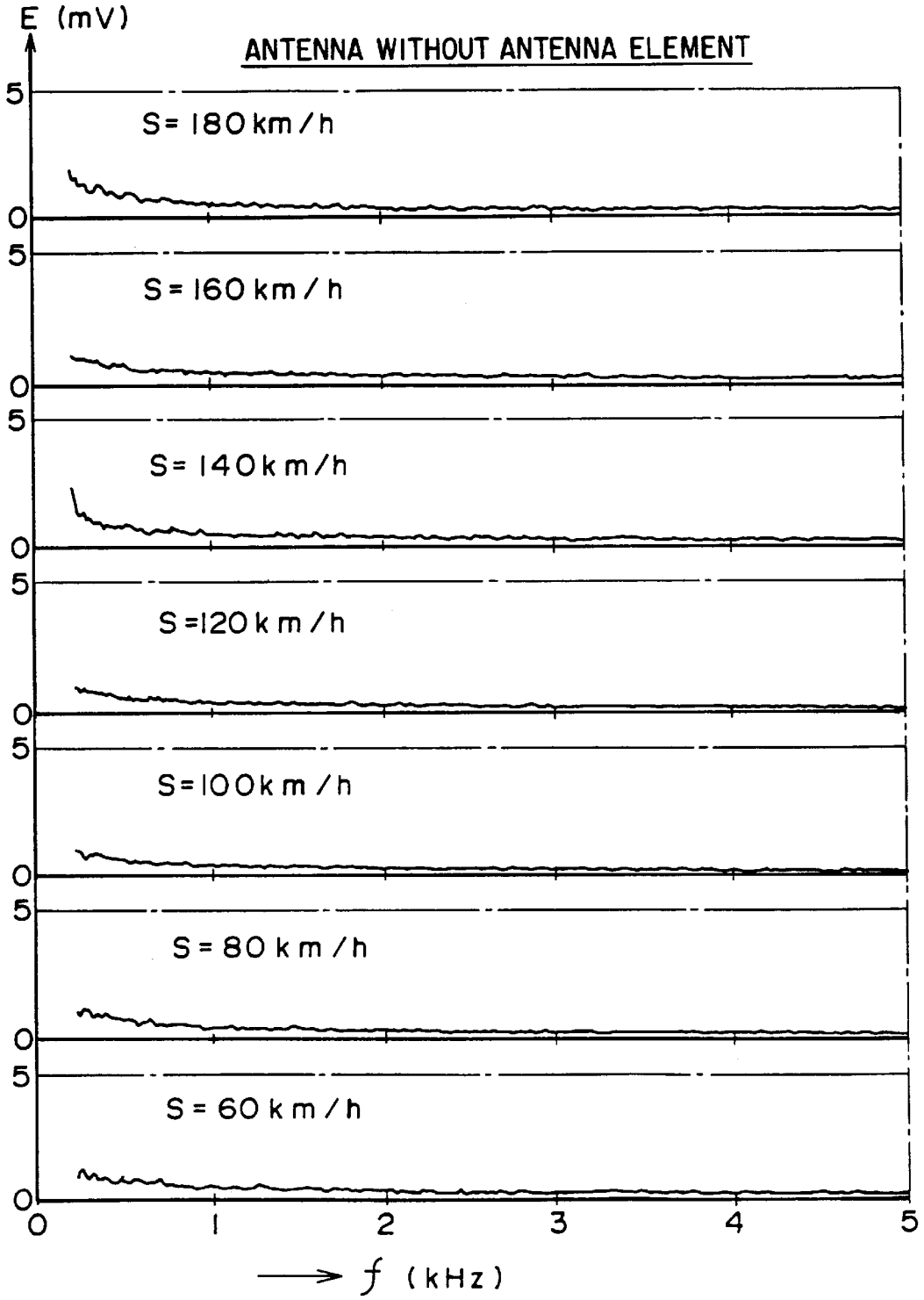
FIG. 16 is a diagram of experimental data for explaining the whistling sound eliminating effect of the rod-shaped automobile antenna without an antenna element according to the first embodiment of the present invention.

(8) Data Arrangement Method MD (FIG. 15)

This method is to obtain the maximum value of outputs of the sensor, which are 2 mV or more, when frequency f ranges from 1.0 kHz to 5 kHz. The corresponding correlation coefficient is 0.7256.

It turned out that the coefficient (0.7399) of the correlation between the audibility estimated value and the arranged by the data arrangement method MC (FIG. 14) largest. To use the data arranged by the method MC as a value for determining "noisiness" of whistling sound can thus be considered to be appropriate. The coefficient (0.7103) of the correlation between the audibility estimated value and the data arranged by the data arrangement method XC (FIG. 10), is quite large. Further, the coefficient of correlation between the data arranged by the methods XC and MC is as large as 0.8458. Thus, it does not matter if the method XC is used in place of the method MC.

FIGS. 16 to 19 are diagrams of data of experiments for explaining the whistling sound eliminating effect of the rod-shaped automobile antenna according to the first embodiment of the present invention. The experiments are performed in the same manner as described above, that is, an acceleration sensor is mounted on the antenna mounting mechanism (mounting section) to which the bottom end of the rod-shaped antenna element is coupled perpendicularly to the horizontal plane. When the wind velocities in the wind tunnel vary every 20 km/h from 60 Km/h to 180 Km/h, signals are picked up by the acceleration sensor and Fourier-transformed, thus obtaining a power spectrum of vibrations transmitted by the rod-shaped antenna element.

The diagrams of FIGS. 16 to 19 are basically the same as those of FIGS. 5 to 7. In each of the graphs, the abscissa indicates a frequency f (kHz) and the ordinate does an amplitude E (mV). In each figure, the region having an amplitude of Ew or larger is a noisy one where one feels noisy.

FIGS. 16 to 19 show experimental data for explaining the whistling sound eliminating effects of a rod-shaped automobile antenna without an antenna element, a normal rod-shaped automobile antenna having no uneven portion on the surface of the antenna element, a rod-shaped automobile antenna having a spiral protrusion on the surface of the antenna element, and a rod-shaped automobile antenna with an antenna element (D2=Φ4) having a step, respectively.

Figure 17:
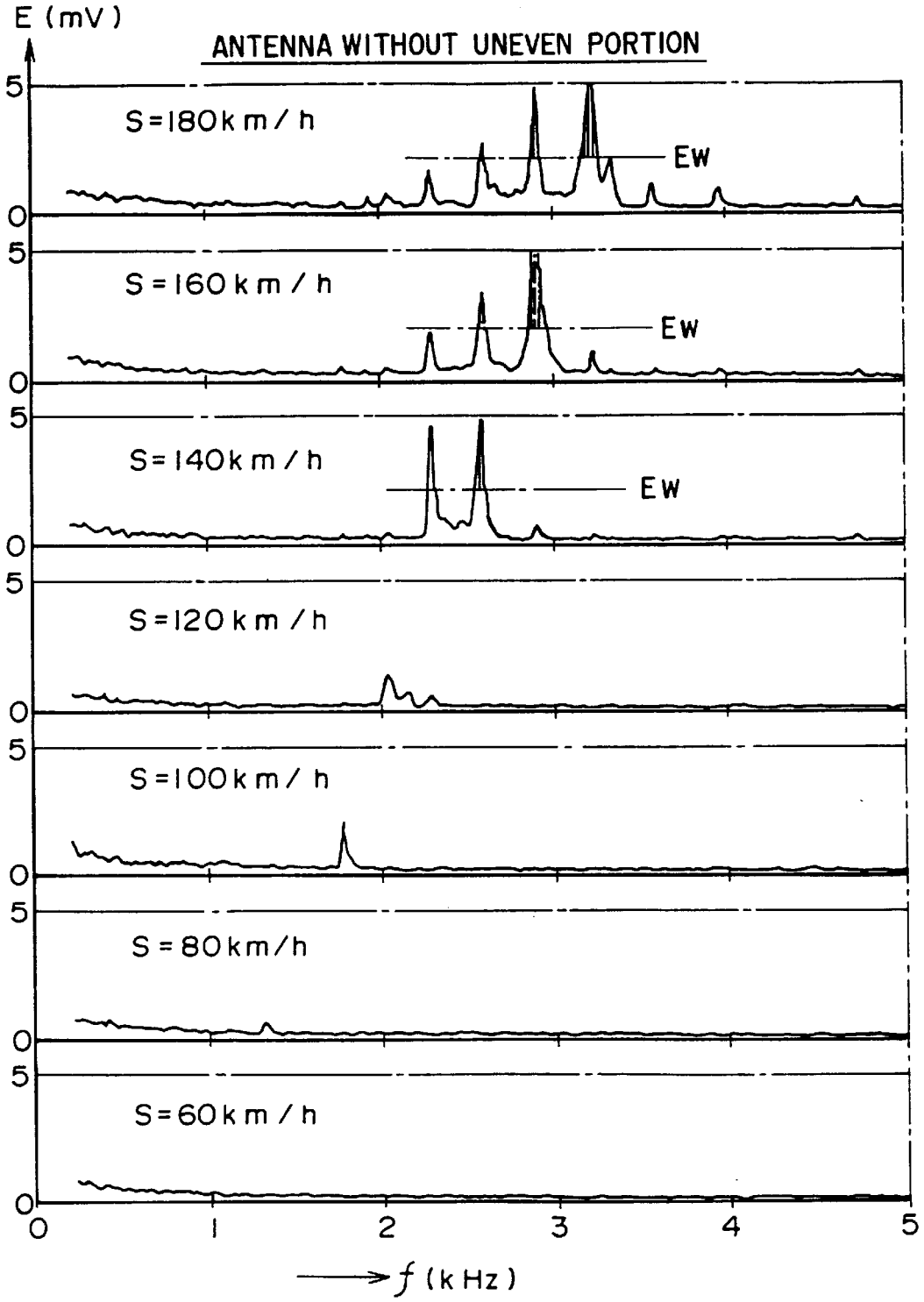
FIG. 17 is a diagram of experimental data for explaining the whistling sound eliminating effect of the rod-shaped automobile antenna without an uneven portion according to the first embodiment of the present invention.
Figure 18:
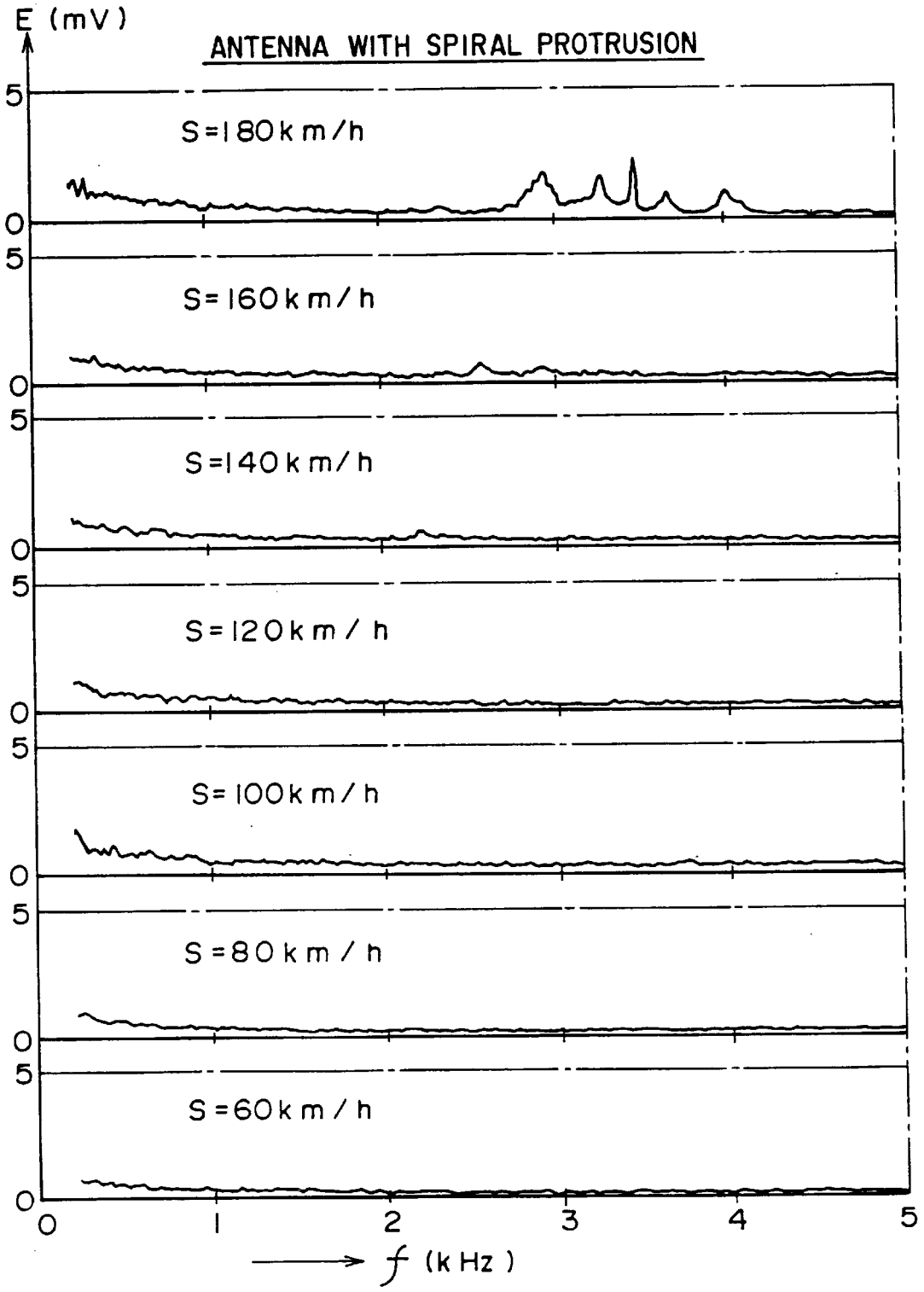
FIG. 18 is a diagram of experimental data for explaining the whistling sound eliminating effect of the rod-shaped automobile antenna with a spiral protrusion according to the first embodiment of the present invention.
Figure 19:
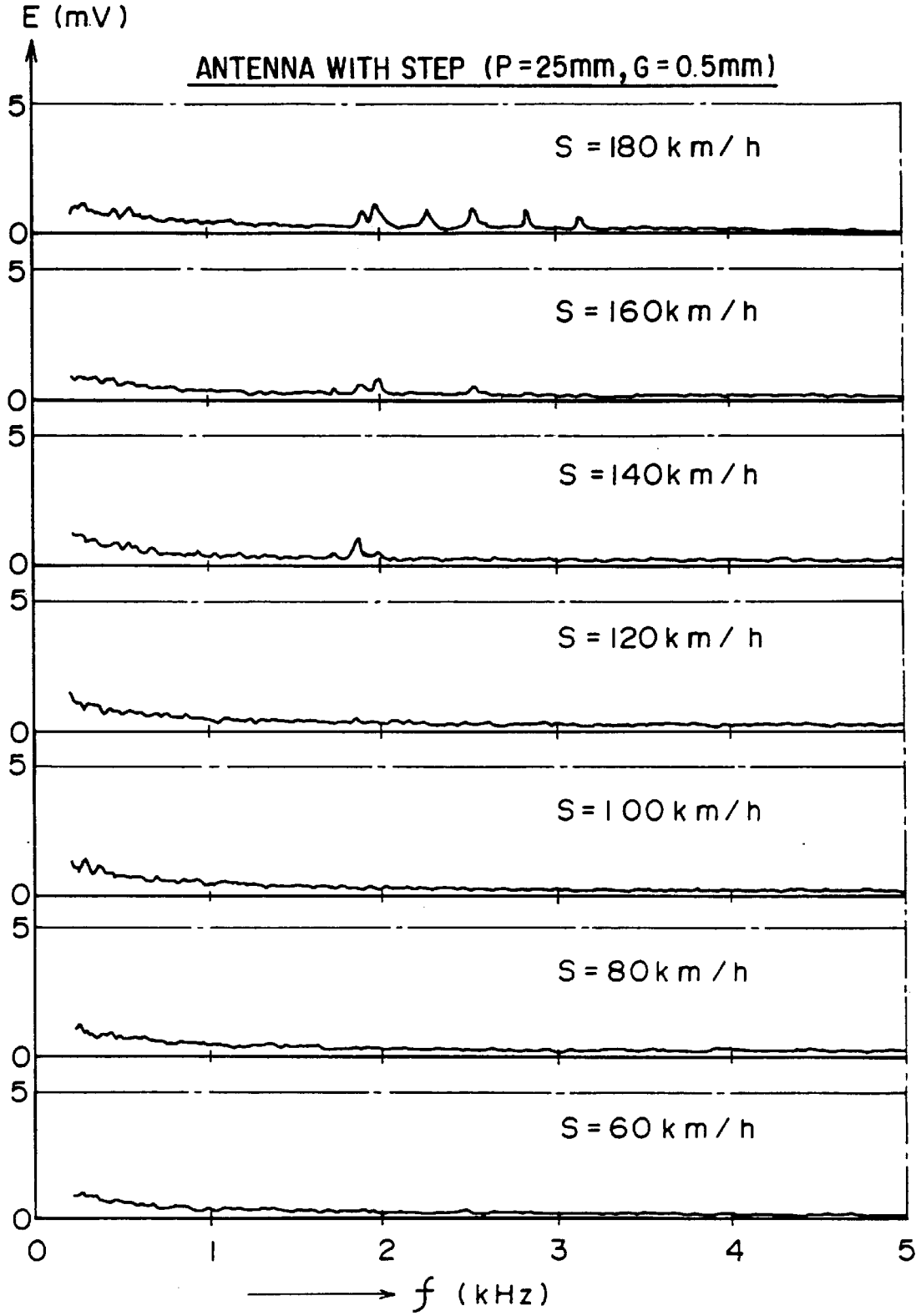
FIG. 19 is a diagram of experimental data for explaining the whistling sound eliminating effect of the rod-shaped automobile antenna with an antenna element having a step according to the first embodiment of the present invention.

Comparing the results of respective experiments obtained when the wind velocity is 180 km/h as shown in FIGS. 16 to 19, a difference in data among them is clarified. More specifically, if a rod-shaped antenna element having no uneven portion on its surface is used, as shown in FIG. 17, a considerably big whistling sound is generated when the wind velocity is 140 km/h or higher. It is seen from FIG. 17 that the vibration frequency tends to increase as the wind velocity becomes great. In the case of a rod-shaped antenna element with a spiral protrusion as shown in FIG. 18, which has been conventionally considered to be able to sufficiently suppress the whistling sound or noise, the whistling sound becomes loud as audibility when the wind velocity reaches 180 km/h. In contrast, if the rod-shaped antenna element 10 of the first embodiment is used as shown in FIG. 19, the whistling sound does not become so loud as audibility when the wind velocity reaches 180 km/h, but is suppressed to a low level.

Figure 20:
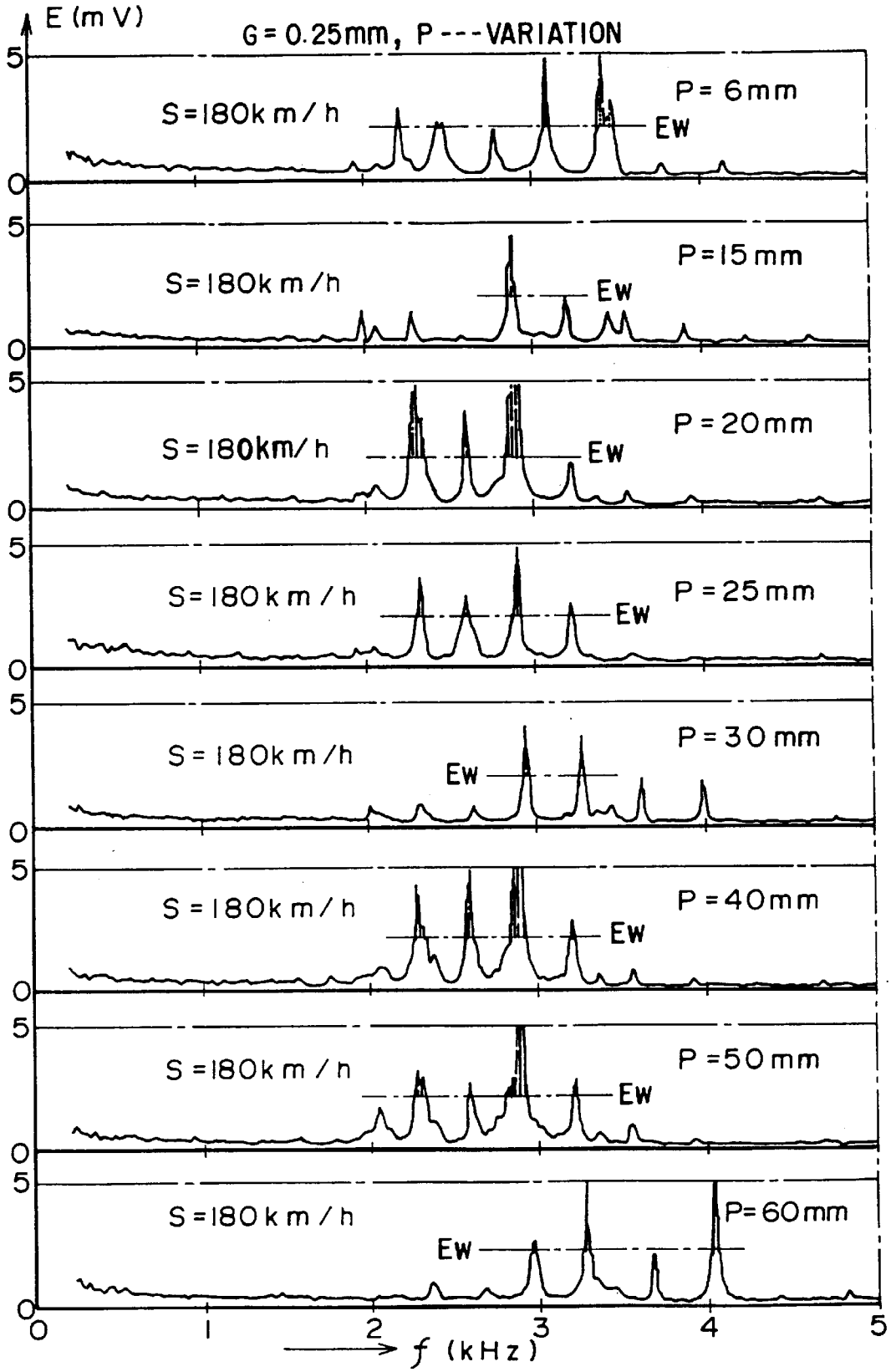
FIG. 20 is a diagram of experimental data for confirming variations in whistling sound eliminating effect when pitch P varies maintaining step G of 0.25 mm in order to obtain the optimum relationship in measurement between the small- and large-diameter portions of the rod-shaped automobile antenna element according to the first embodiment of the present invention.
Figure 21:
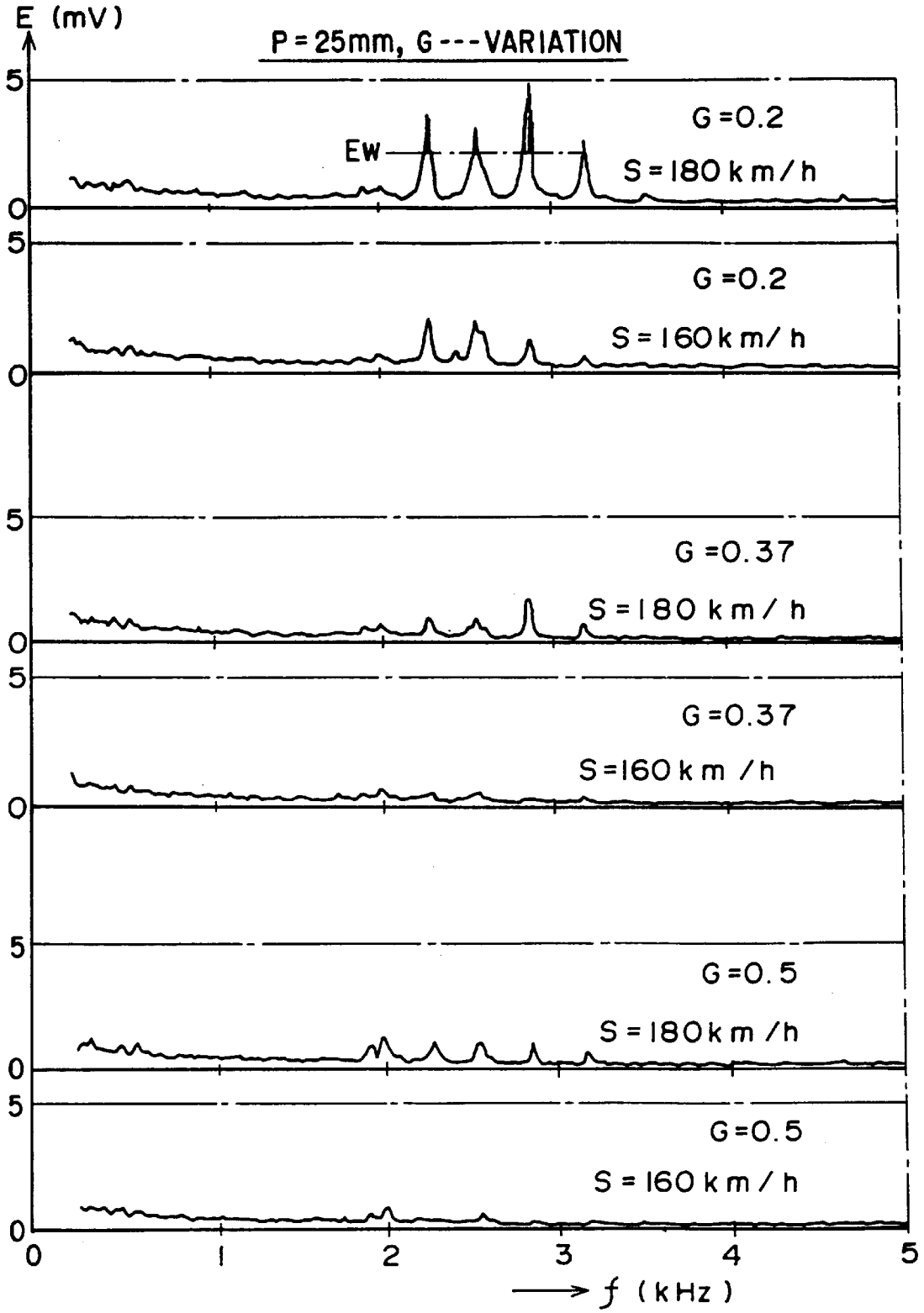
FIG. 21 is a diagram of experimental data for confirming variations in whistling sound eliminating effect when step G varies maintaining pitch P of 25 mm in order to obtain the optimum relationship in measurement between the small- and large-diameter portions of the rod-shaped automobile antenna element according to the first embodiment of the present invention.
Figure 22:
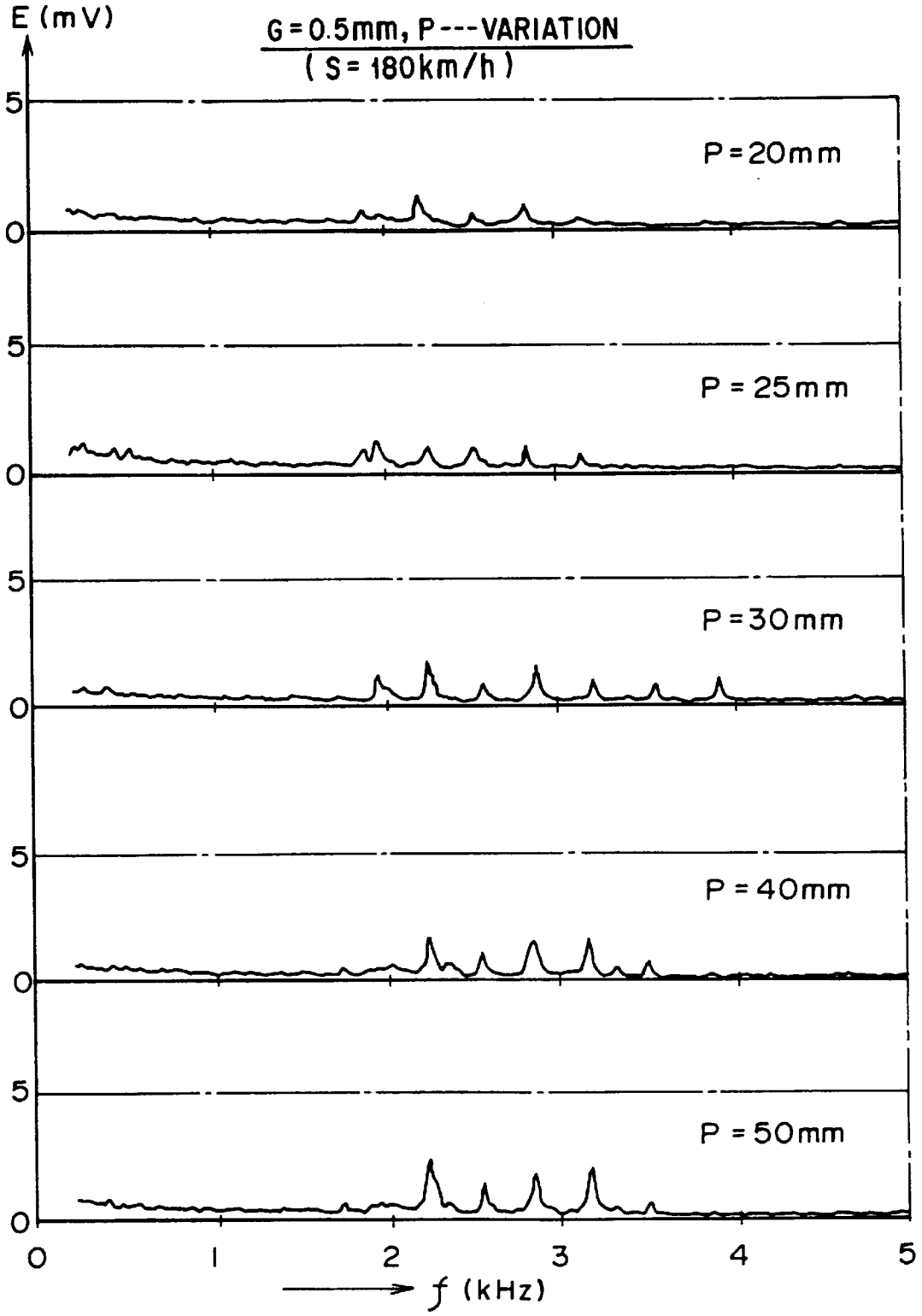
FIG. 22 is a diagram of experimental data for confirming variations in whistling sound eliminating effect when pitch P varies maintaining step G of 0.5 mm in order to obtain the optimum relationship in measurement between the small- and large-diameter portions of the rod-shaped automobile antenna element according to the first embodiment of the present invention.

FIGS. 20 to 22 are diagrams of data of experiments performed to obtain the optimum relationship in measurement between the small- and large-diameter portions 11 and 12 of the rod-shaped automobile antenna element 10 which produces good whistling sound eliminating results as shown in FIG. 19.

FIG. 20 shows measurement results of a vibration power spectrum when a wind tunnel test is performed at wind velocity of 180 km/h, while the rod-shaped antenna element 10 in which a difference in level (step) G between the small- and large-diameter portions 11 and 12 is set to 0.25 mm and pitch P is set to 6 mm, 15 mm, 20 mm, 25 mm, 30 mm, 40 mm, 50 mm and 60 mm, is arranged at right angles to the direction of wind. It is seen from FIG. 20 that relatively good measurement results are obtained when pitch P is set to 15 mm, 25 mm and 30 mm, and the best measurement result is obtained as the actual audibility when pitch P is 25 mm.

FIG. 21 shows measurement results of a vibration power spectrum when a wind tunnel test is performed at wind velocities of 180 km/h and 160 km/h, while the rod-shaped antenna element 10 in which pitch P between the small- and large-diameter portions 11 and 12 is set to 25 mm and step G therebetween is set to 0.2 mm, 0.37 mm and 0.5 mm, is arranged at right angles to the direction of wind. As apparent from FIG. 21, the greater step G, the better the measurement results. If step G is set to 0.4 mm to 0.5 mm, sufficiently good whistling sound eliminating results can be obtained.

FIG. 22 shows measurement results of a vibration power spectrum when a wind tunnel test is performed at wind velocity of 180 km/h, while the rod-shaped antenna element 10 in which step G between the small- and large-diameter portions 11 and 12 is set to 0.5 mm and pitch P is set to 20 mm, 25 mm, 30 mm, 40 mm and 50 mm, is arranged at right angles to the direction of wind. As shown in FIG. 22, good measurement results are obtained irrespective of the values of pitch P, but the best results for the actual audibility are when pitch P is 25 mm. The outside diameter D2 of the large-diameter portion 12 is not limited to Φ4 but can be set to Φ3 to Φ5 and, in this case, good results are produced if pitch P ranges from 24 mm to 28 mm.

Figure 23:
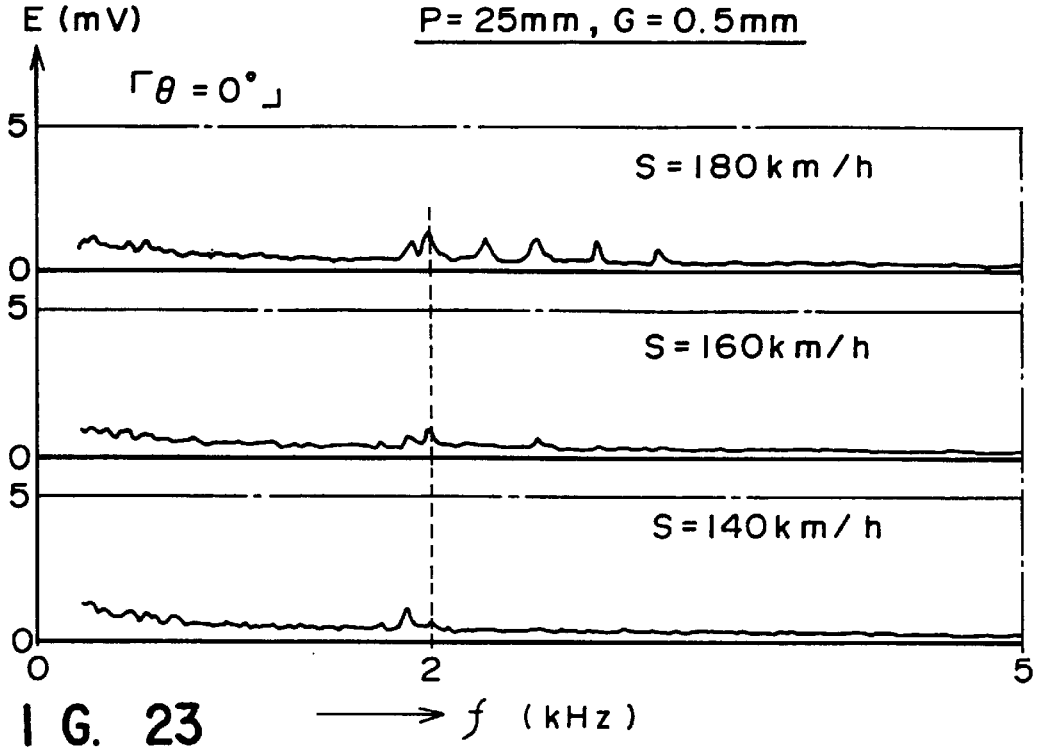
FIG. 23 is a diagram of experimental data on the whistling sound eliminating effect when the rod-shaped automobile antenna according to the first embodiment of the present invention is mounted on an automobile body at an angle θ of 0° (an angle of inclination to the vertical direction)
Figure 24:
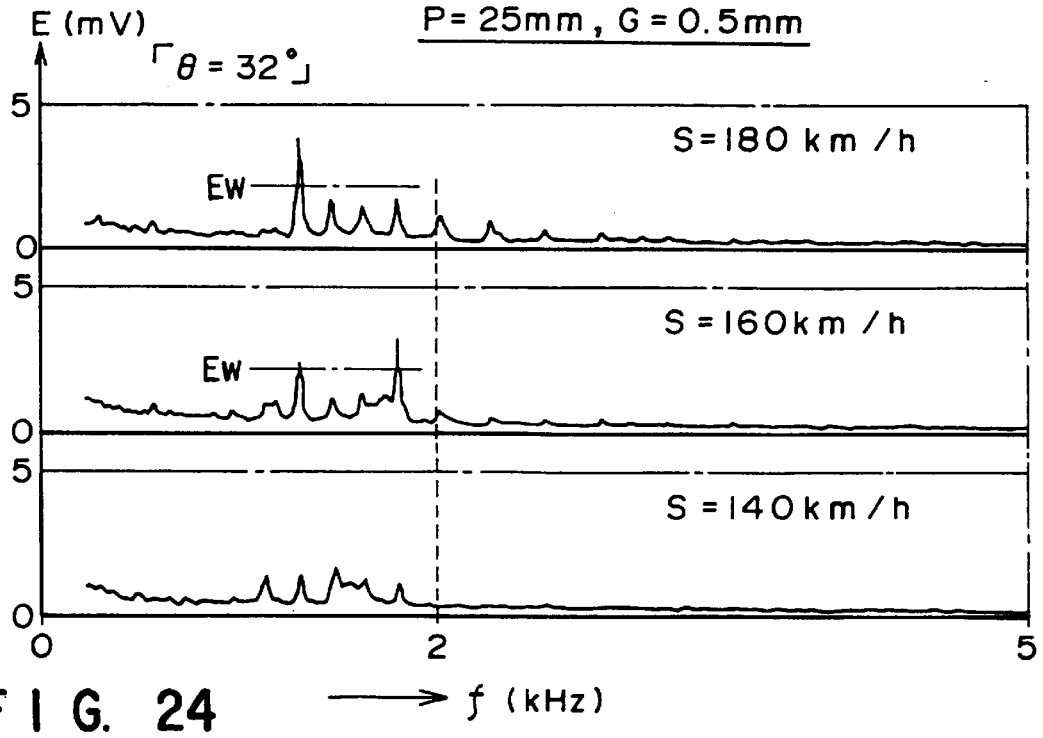
FIG. 24 is a diagram of experimental data on the whistling sound eliminating effect when the rod-shaped automobile antenna according to the first embodiment of the present invention is attached to an automobile body at an angle θ of 32° (an angle of inclination to the vertical direction)

FIGS. 23 and 24 show one of results of experiments to perform whether the whistling sound varies when the rod-shaped automobile antenna element 10 is inclined and mounted on an automobile body at a predetermined angle. It has turned out that if the antenna element 10 is inclined, the vibration frequency spectrum varies greatly and the amplitude is not fixed but varied with surrounding conditions.

It is apparent from the comparison of FIGS. 23 and 24 that the amplitude of the antenna element 10 slightly inclined (at an inclination angle θ of 32° to the vertical direction) is larger than that of the antenna element 10 vertically standing (at an inclination angle θ of 0° to the vertical direction). However, as shown in FIG. 24, a frequency band of large amplitude has a frequency which is lower than that (2 to 5 kHz) of a frequency band which one feels noisy as audibility. It is not therefore correct to conclude that one feels noisier when the antenna element is inclined at an angle of 32°.

In the above experiments, the whistling sound generated when the antenna element 10 is inclined, is not particularly louder than when the antenna element 10 is mounted vertically.

(Second Embodiment)

Figure 25:
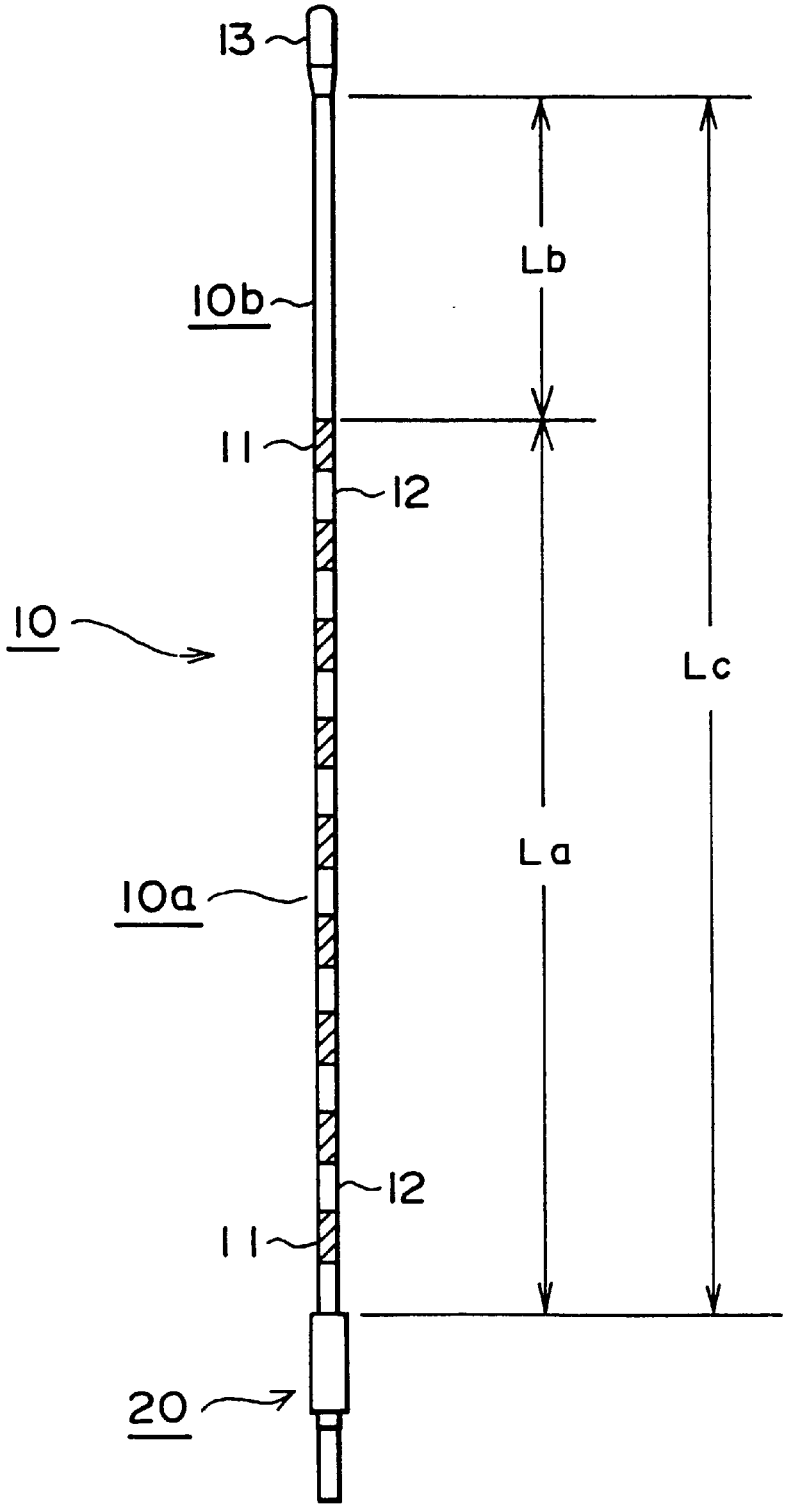
FIG. 25 is a front view of the constitution of a rod-shaped automobile antenna according to a second embodiment of the present invention.

FIG. 25 is a front view illustrating the constitution of a rod-shaped antenna element 10 according to a second embodiment of the present invention.

The antenna element 10 includes an area 10*a* extending from the bottom end thereof and having a length La which is ⅔ or more of the whole length Lc. Only in this area 10*a*, small- and large-diameter portions 11 and 12 are formed alternately. Therefore, the element 10 has a top end portion 10*b* of length Lb where neither small-diameter portions nor large-diameter portions are formed. It has been confirmed that the rod-shaped antenna element 10 having such a constitution produces the same whistling sound eliminating effect as that of the antenna element of the first embodiment.

Figure 26:
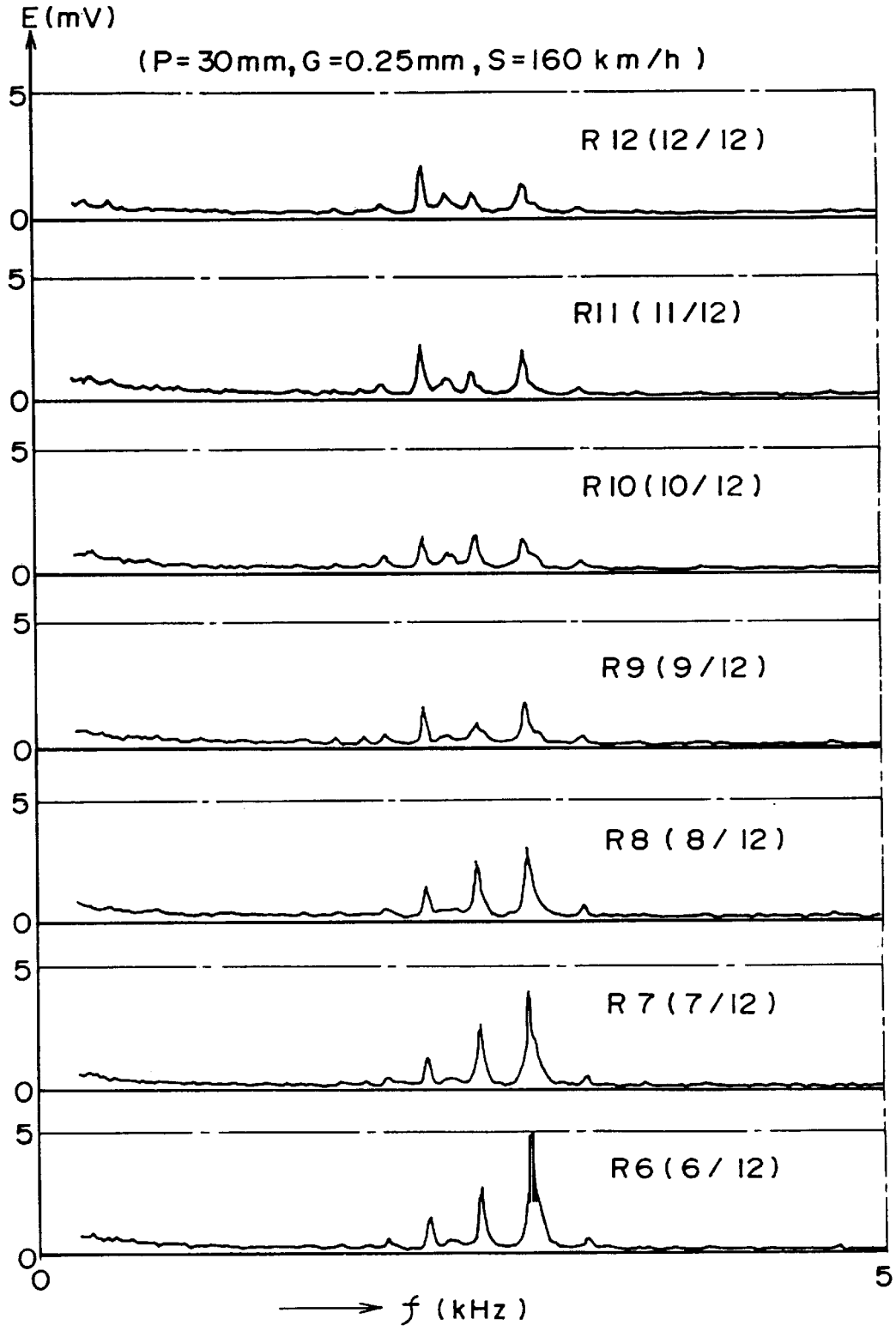
FIG. 26 is a diagram of experimental data for confirming variations in whistling sound eliminating effect when the steps, formed from the proximal portion of an antenna element toward the distal portion thereof, varies in number in order to obtain a step forming rate per surface of a rod-shaped conductor, which is required by the rod-shaped automobile antenna according to the second embodiment of the present invention.

FIG. 26 is a diagram of results of the experiment to confirm the whistling sound eliminating effect of the rod-shaped antenna element 10 of the second embodiment.

To carry out the experiment, a reference sample R12 having twelve steps G (each corresponding to a difference in level between the small- and large-diameter portions 11 and 12) formed from the bottom end of a rod-shaped conductor to the top end thereof, is prepared and so are the other reference samples R11, R10, R9, R8, R7 and R6 whose steps G are reduced in number one by one from top, thereby to measure a vibration power spectrum for each of the samples. The experiment was performed under condition that pitch P is 30 mm, step G is 0.25 mm and wind velocity is 160 Km/h.

As shown in FIG. 26, it has turned out that the whistling sound cannot be ignored when the number of steps G formed from the bottom end of the rod-shaped conductor to the top end thereof reaches about 8. In other words, it has turned out that the whistling sound eliminating effect is lost if the steps are reduced ⅓ or more.

(Third Embodiment)

Figure 27:
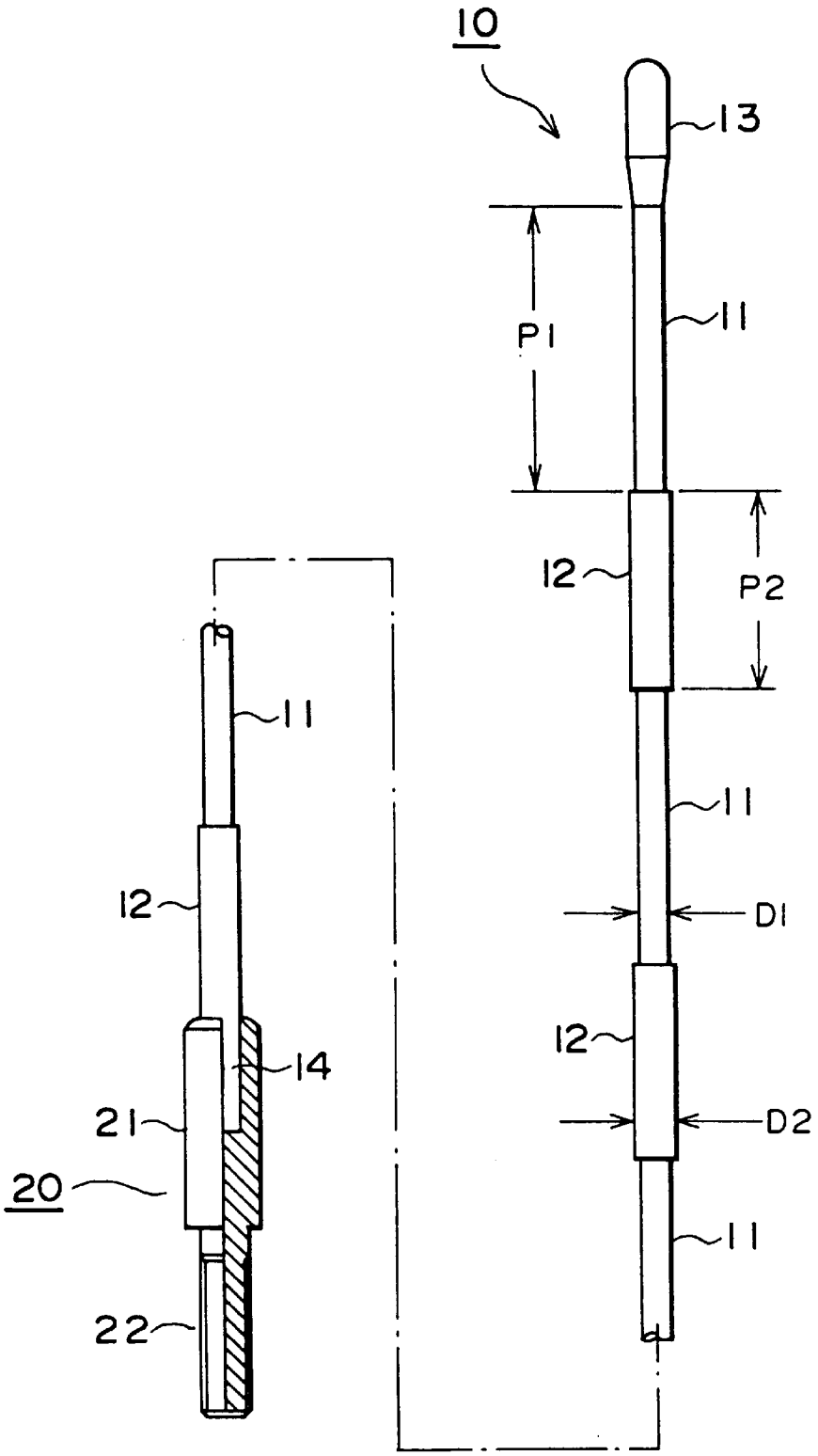
FIG. 27 is a front view of the constitution of a rod-shaped automobile antenna according to a third embodiment of the present invention.

FIG. 27 is a front view showing the constitution of a rod-shaped antenna element 10 according to a third embodiment of the present invention. This antenna element 10 includes small- and large-diameter portions 11 and 12 arranged alternately at regular pitches along the longitudinal direction of a rod-shaped conductor. Assume that the outside diameters of the small- and large-diameter portions 11 and 12 are D1 and D2, respectively and that the lengths thereof are P1 and P2, respectively. If D2 is Φ4, P1 and P2 are set within the following ranges:

$$(D2\times 6)\leqq P1\leqq (D2\times 7)$$

$$(D2\times 6)\leqq P2\leqq (D2\times 7)$$

The ratio Q of P1 to P2 (P1/P2) or P2 to P1 (P2/P1) falls within the following range:

$$(1/3)\leqq Q\leqq 1$$

The ratio of D1 to D2 (D1/D2) set as follows:

$$(D1/D2)\leqq 0.75$$

Except for the above constitution, the rod-shaped antenna element 10 of the third embodiment is the same as that of the first embodiment.

FIGS. 28 to 33 are diagrams of results of experiments performed to confirm the whistling sound eliminating effects of the rod-shaped antenna element 10 of the third embodiment.

Figure 28:
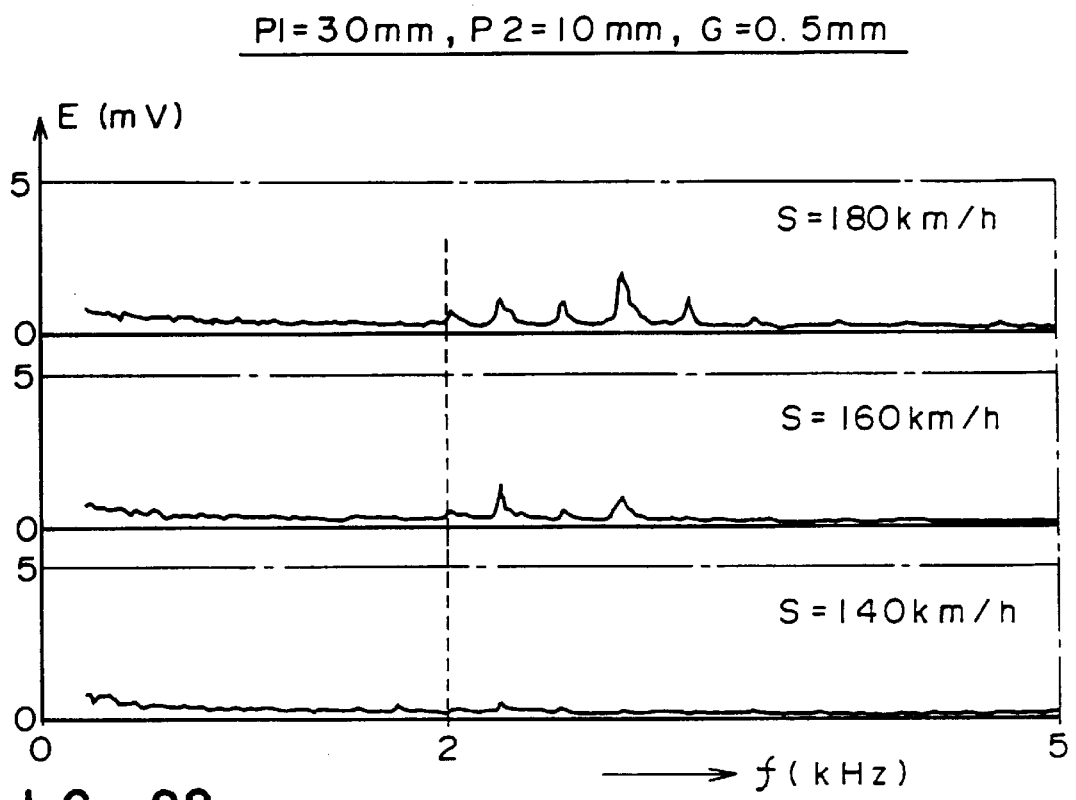
FIG. 28 is a diagram of experimental data for confirming variations in whistling sound eliminating effect when lengths P1 and P2 of the small and large diameter portions of an antenna element are predetermined values, and the step G is 0.5 mm in order to obtain a relationship in measurement between the small and large diameter portions on a rod-shaped conductor, which is required by the rod-shaped automobile antenna according to the third embodiment of the present invention.
Figure 29:
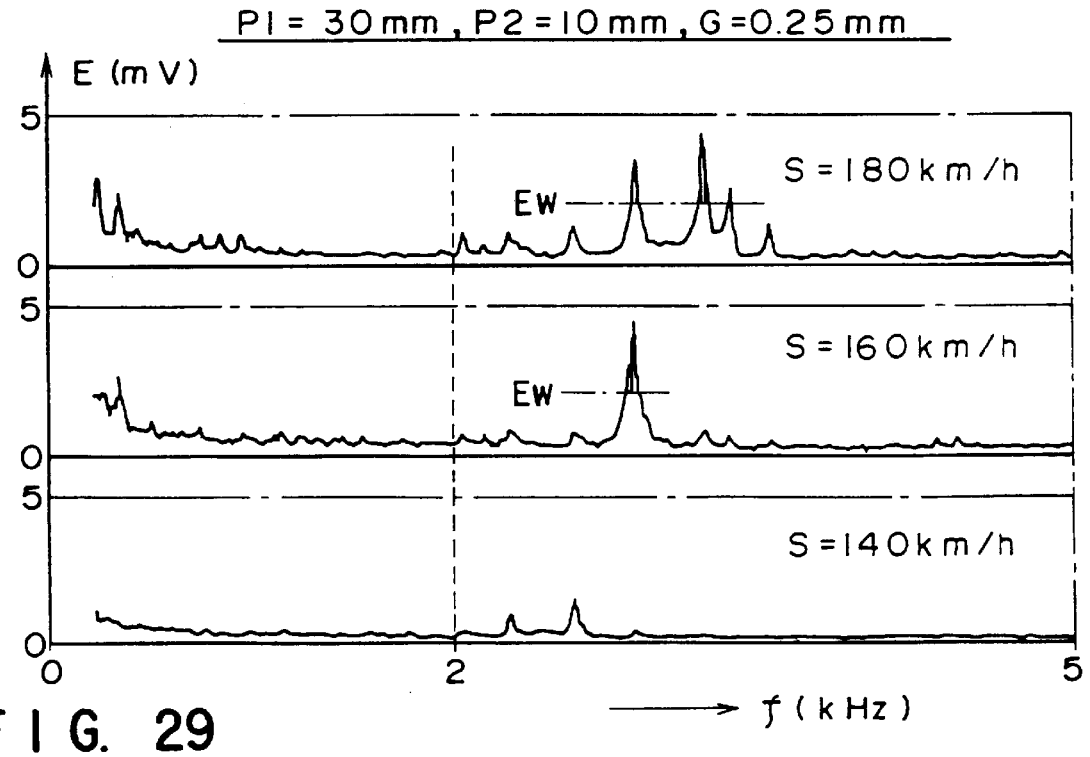
FIG. 29 is a diagram of experimental data for confirming variations in whistling sound eliminating effect when lengths P1 and P2 of the small and large diameter portions of an antenna element are predetermined values, and the step G is 0.25 mm in order to obtain a relationship in measurement between the small and large diameter portions on a rod-shaped conductor, which is required by the rod-shaped automobile antenna according to the third embodiment of the present invention.

It has turned out that the whistling sound cannot be ignored when P1=30 mm, P2=10 mm, and G=0.25 mm as shown in FIG. 29 whereas it can be almost eliminated when P1=30 mm, P2=10 mm, and G=0.5 mm as shown in FIG. 28.

Figure 30:
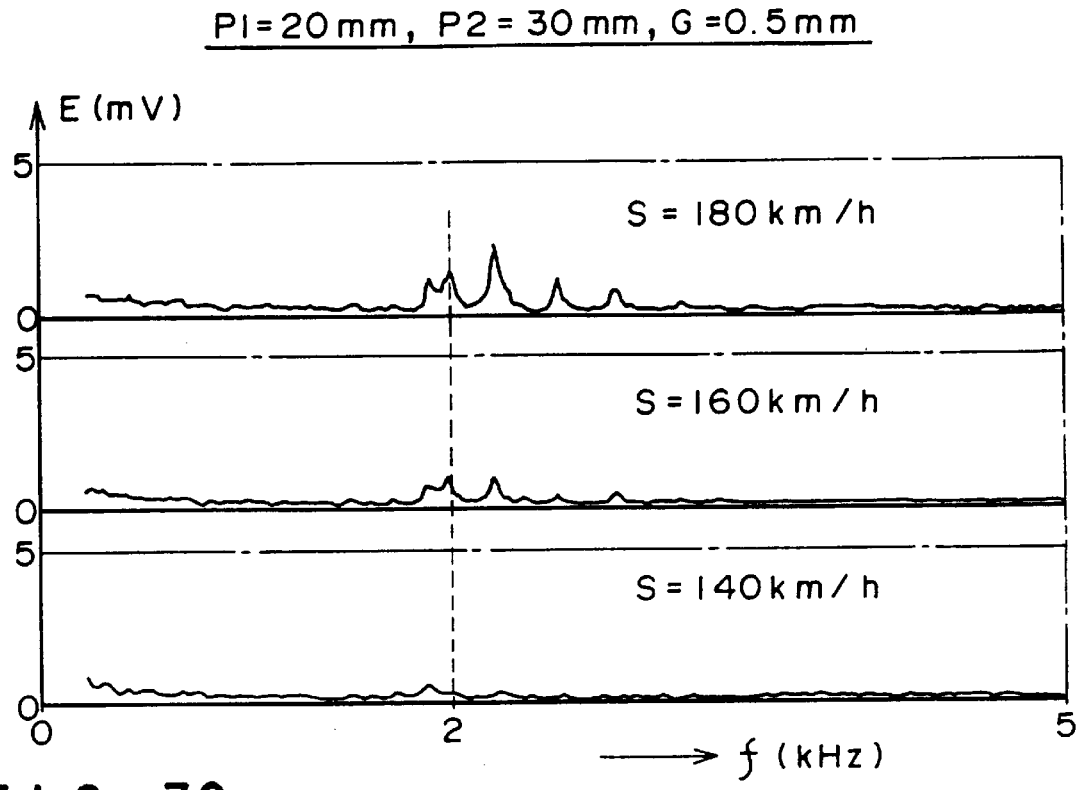
FIG. 30 is a diagram of experimental data for confirming variations in whistling sound eliminating effect when lengths P1 and P2 of the small and large diameter portions of an antenna element are predetermined values, and the step G is 0.5 mm in order to obtain a relationship in measurement between the small and large diameter portions on a rod-shaped conductor, which is required by the rod-shaped automobile antenna according to the third embodiment of the present invention.
Figure 31:
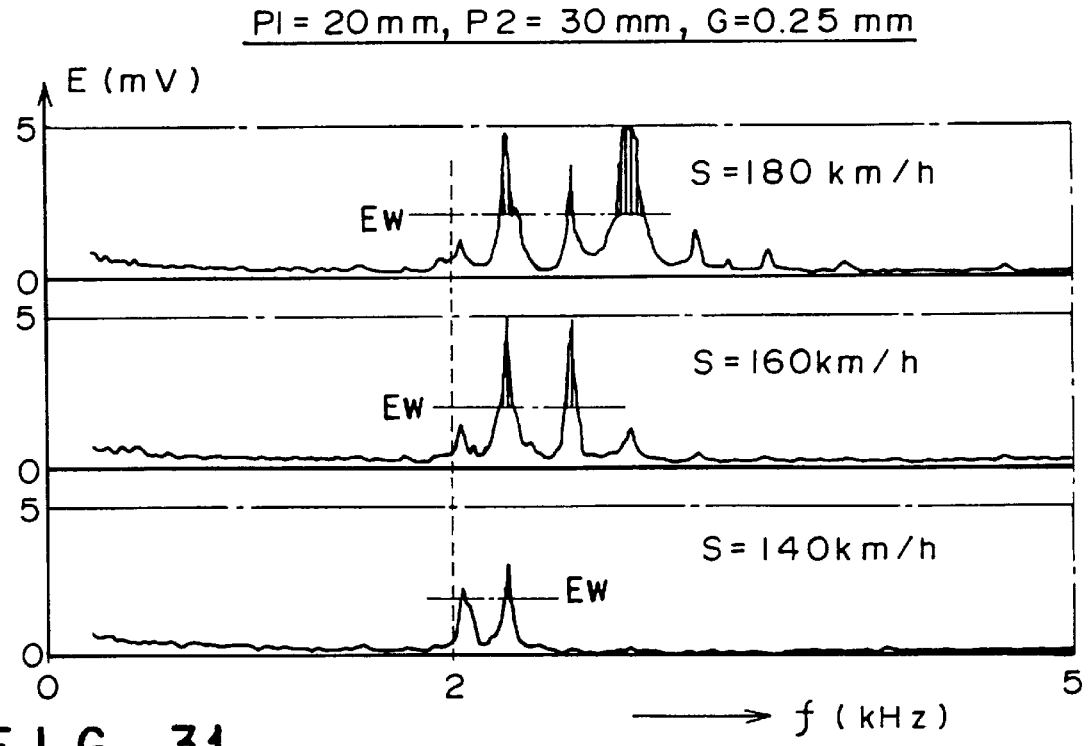
FIG. 31 is a diagram of experimental data for confirming variations in whistling sound eliminating effect when lengths P1 and P2 of the small and large diameter portions of an antenna element are predetermined values, and the step G is 0.25 mm in order to obtain a relationship in measurement between the small and large diameter portions on a rod-shaped conductor, which is required by the rod-shaped automobile antenna according to the third embodiment of the present invention.

It has turned out that the whistling sound cannot be ignored when P1=20 mm, P2=30 mm, and G=0.25 mm as shown in FIG. 31 whereas it can be suppressed when P1=20 mm, P2=30 mm, and G=0.5 mm as shown in FIG. 30.

Figure 32:
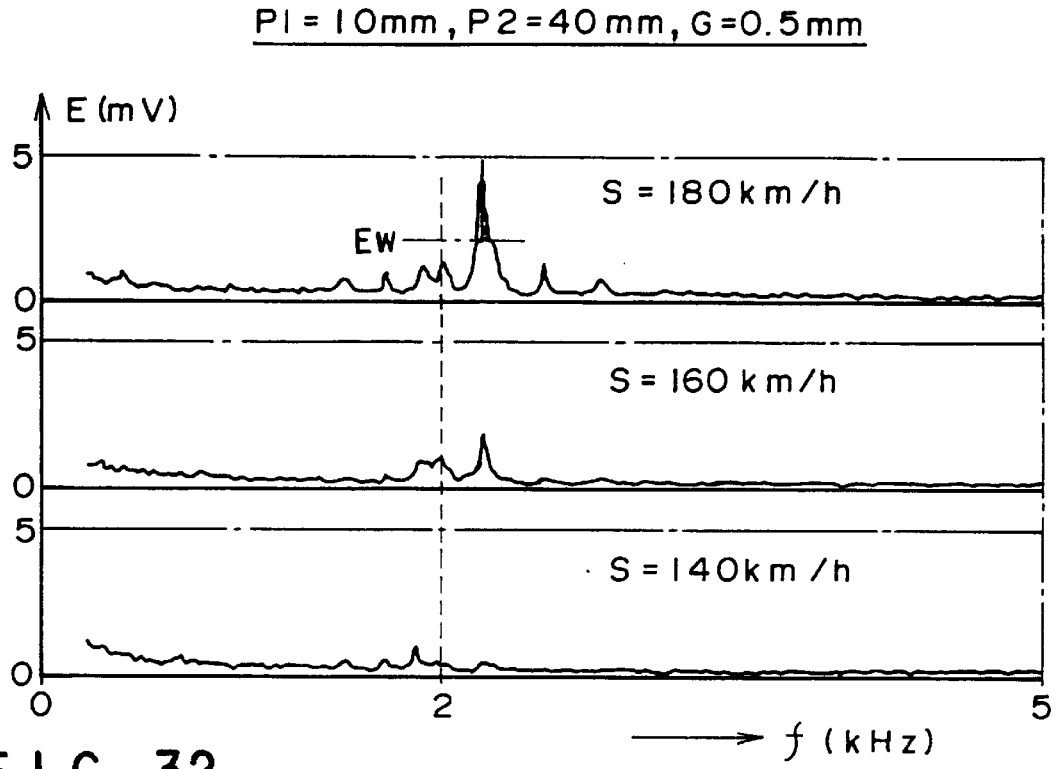
FIG. 32 is a diagram of experimental data for confirming variations in whistling sound eliminating effect when lengths P1 and P2 of the small and large diameter portions of an antenna element are predetermined values, and the step G is 0.5 mm in order to obtain a relationship in measurement between the small and large diameter portions on a rod-shaped conductor, which is required by the rod-shaped automobile antenna according to the third embodiment of the present invention.
Figure 33:
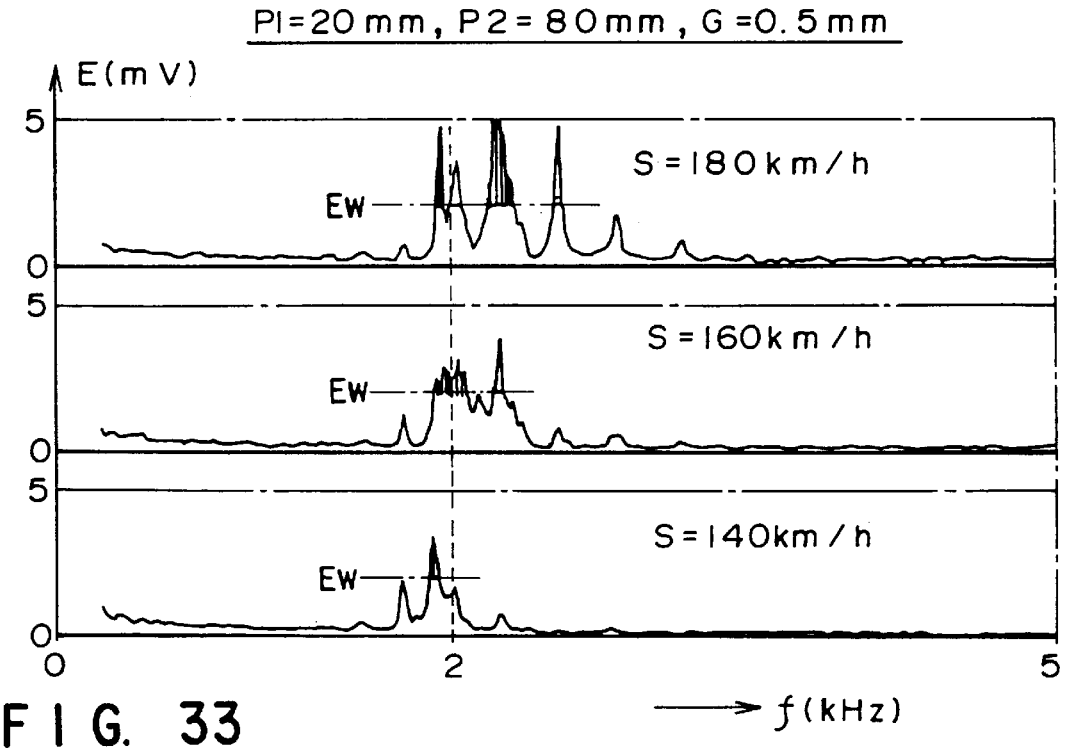
FIG. 33 is a diagram of experimental data for confirming variations in whistling sound eliminating effect when lengths P1 and P2 of the small and large diameter portions of an antenna element are predetermined values, and the step G is 0.25 mm in order to obtain a relationship in measurement between the small and large diameter portions on a rod-shaped conductor, which is required by the rod-shaped automobile antenna according to the third embodiment of the present invention.

It has turned out that the whistling sound eliminating effect cannot be expected if the wind velocity reaches 180 Km/h, even though G is set to 0.5 mm when P1=10 mm and P2=40 mm as shown in FIG. 32 or when P1=20 mm and P2=80 mm as shown in FIG. 33.

(Modifications)

The rod-shaped automobile antenna according to the first and second embodiments can be modified as follows:

i) A rod-shaped antenna element having small- and large-diameter portions which is formed by fitting a plurality of cylindrical members of, e.g., ABS resin into a rod-shaped conductor at regular intervals.

ii) A rod-shaped antenna element which is formed by fitting a plurality of cylindrical members into a rod-shaped conductor and has an adjusting means for properly adjusting an interval between adjacent ones of the cylindrical members.

(Features of Embodiments)

The rod-shaped automobile antenna according to the first and second embodiments has the following features:

(1) A rod-shaped automobile antenna includes a rod-shaped antenna element 10 having small- and large-diameter portions 11 and 12 arranged alternately at regular pitches along the longitudinal direction of a rod-shaped conductor. When the outside diameter of each of the small-diameter portions 11 is D1, that of each of the large-diameter portions 12 is D2, and the pitch (length of each of the small- and large-diameter portions) is P, the pitch P is set within the following range:

$$(D2\times 6)\leqq P\leqq (D2\times 7)$$

The ratio of D1 to D2, that is, D1/D2 is set within the following range:

$$0.7\leqq (D1/D2)\leqq 0.85.$$

In the above rod-shaped automobile antenna, when the antenna element 10 is made of a rod-shaped conductor of, e.g., Φ4, the outside diameter D2 of the large-diameter portion 12 is Φ4 and accordingly P ranges from 24 mm to 28 mm and D1 ranges from 2.8 mm to 3.4 mm. Thus, step G is between 0.6 mm and 0.3 mm. The antenna element 10 having such numeric values is simple in constitution but capable of creating a sufficient whistling sound eliminating effect as shown in FIG. 5 or 19.

(2) In the rod-shaped automobile antenna according to the above paragraph (1), D1 is set to Φ3, D2 is set to Φ4 and P is set to 25 mm.

This antenna reliably produces the same effect as that of the antenna according to the above paragraph (1).

(3) In the rod-shaped automobile antenna according to the above paragraph (1), an area 10*a* in which the small- and large-diameter portions 12 are formed alternately, has a length La which is ⅔ or more of the whole length Lc of the antenna element.

This antenna produces the same effect as that of the antenna according to the above paragraph (1). Since the small- and large-diameter portions 11 and 12 have only to be provided within the necessary minimum range, the number of manufacturing steps can be decreased, as can be the area for the small- and large-diameter portions. Therefore, the antenna is advantageous to holding the mechanical strength of the antenna element.

(4) A rod-shaped automobile antenna includes a rod-shaped antenna element 10 having small- and large-diameter portions 11 and 12 arranged alternately at regular pitches along the longitudinal direction of a rod-shaped conductor. When the outside diameter of each of the small-diameter portions 11 is D1, the length thereof is P1, the outside diameter of each of the large-diameter portions 12 is D2, and the length thereof is P2, P1 and P2 are set within the following range:

$$(D2\times 6)\leqq P1\leqq (D2\times 7)$$

$$(D2\times 6)\leqq P2\leqq (D2\times 7)$$

The ratio Q of P1 to P2 (P1/P2) or P2 to P1 (P2/P1) falls within the following range:

$$(1/3)\leqq Q\leqq 1$$

The ratio of D1 to D2 (D1/D2) set as follows:

$$(D1/D2)\leqq 0.75$$

In the above rod-shaped automobile antenna, when the antenna element 10 is made of a rod-shaped conductor of, e.g., Φ4, the outside diameter D2 of the large-diameter portion 12 is Φ4 and accordingly P1 and P1 are each set within a range from 24 mm to 28 mm. The ratio Q of P1 to P2 (P1/P2) or P2 to P1 (P2/P1) is set between 1:3 and 1:1, and D1 is 3.0 mm or less. Thus, step G is 0.5 mm or more. The antenna element 10 having such numeric values is simple in constitution but capable of creating a sufficient whistling sound eliminating effect as shown in FIG. 28 or 30. Since, moreover, P1 and P2 can be properly set within an allowable range, the small- and large-diameter portions 11 and 12 can be formed in the best mode in view of design and mechanical strength.

(5) In the rod-shaped automobile antenna according to one of the above paragraphs (1), (3) or (4), the rod-shaped antenna element 10 having small- and large-diameter portions 11 and 12 is constituted of a single member by deforming a rod-shaped conductor by a deforming means such as cutting and swaging.

This antenna creates the same effect as that of the antenna according to each of the above paragraphs (1), (3) or (4). Since, furthermore, the antenna element 10 including a cap portion 13 can be formed of a single member, the number of constituting elements is small and the cost of materials is low.

(6) In the rod-shaped automobile antenna according to the modifications or one of the above paragraphs (1), (3) or (4), the rod-shaped antenna element 10 having small- and large-diameter portions 11 and 12 is formed by fitting a plurality of cylindrical members on the outer circumference of a rod-shaped conductor at regular intervals but without processing the rod-shaped conductor.

Since, in the rod-shaped automobile antenna, the antenna element 10 need not be processed, it is unlikely to be decreased in mechanical strength. Since, furthermore, the cylindrical members are fitted intermittently at regular intervals, the flexibility inherent in the element 10 is not degraded even though the cylindrical members are formed of considerably hard materials. When the cylindrical members are made of resin such as ABS resin, even if they are fitted into the antenna element 10, the resin is unlikely to have an adverse influence upon the function of the antenna, and the cylindrical members are easy to manufacture and can thus be correctly fitted on the outer circumference of the rod-shaped conductor with no gaps therebetween.

(7) The rod-shaped automobile antenna according to the modifications or the above paragraph (6) comprises an adjusting means for properly adjusting an interval between adjacent ones of the cylindrical members fitted into the rod-shaped conductor.

This antenna creates the same effect as that of the antenna according to the above paragraph (6).

Since the length of each of the small-diameter portion 11 can be varied properly and so can be the distance between adjacent cylindrical members, the antenna can easily be adapted to its using conditions.

(8) The rod-shaped automobile antenna includes a rod-shaped antenna element 10 having small- and large-diameter portions 11 and 12 arranged alternately at regular pitches P along the longitudinal direction of a rod-shaped conductor. The outside diameter D2 of each of the large-diameter portions 12 ranges from Φ3 to Φ5, the pitch P is set within a range of 24 mm to 28 mm, and a step (difference) G between the outside diameter D2 of the large-diameter portion 12 and that D1 of the small-diameter portion 11 is set to 0.5 mm or more.

This antenna, which creates a sufficient whistling sound eliminating effect, can be manufactured easily and exactly and reduced to practice very easily.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A rod vehicle antenna including a rod antenna element having small-diameter portions and large-diameter portions arranged alternately at regular pitches along a longitudinal direction of a rod conductor, wherein when an outside diameter of each of the small-diameter portions is D1, a length thereof is P1, an outside diameter of each of the large-diameter portions is D2, and a length thereof is P2, P1 and P2 are set within a following range:

$$(D2\times 6)\leqq P1\leqq (D2\times 7)$$

$$(D2\times 6)\leqq P2\leqq (D2\times 7);$$

a ratio Q of P1 to P2 (P1/P2) or P2 to P1 (P2/P1) falls within a following range:

$$(1/3)\leqq Q\leqq 1;$$

a ratio of D1 to D2 (D1/D2) is set as follows:

$$(D1/D2)\leqq 0.75;\text{ and}$$

wherein the rod antenna element has an area where the small-diameter portions and the large-diameter portions are formed, and a length of the area is ⅔ or more of a whole length of the rod antenna element.

2. The rod vehicle antenna according to claim 1, wherein the small-diameter portions and large-diameter portions are arranged alternatively at regular pitches P along the longitudinal direction of the rod conductor;

wherein the difference between outside diameter of small-diameter portions D1 and outside diameter of large-diameter portions D2 is a step difference G;

wherein the outside diameter of the large-diameter portions is D2 is set within the following range:

$$\Phi 3\text{–}\Phi 5;$$

wherein the pitch P is set within the following range:

24 mm–28 mm; and wherein the step difference G is set within the following range:

0.5 mm or greater.

* * * * *